US007019706B2

(12) United States Patent
Yoneda et al.

(10) Patent No.: US 7,019,706 B2
(45) Date of Patent: Mar. 28, 2006

(54) HIGH FREQUENCY MODULE AND ANTENNA DEVICE

(75) Inventors: Naofumi Yoneda, Tokyo (JP); Moriyasu Miyazaki, Tokyo (JP); Tetsu Ohwada, Tokyo (JP); Hideyuki Oh-Hashi, Tokyo (JP); Koji Yamanaka, Tokyo (JP); Kazutomi Mori, Tokyo (JP); Yukio Ikeda, Tokyo (JP); Toshiyuki Horie, Tokyo (JP); Akio Iida, Tokyo (JP); Yutaka Ozaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/508,832

(22) PCT Filed: Mar. 20, 2003

(86) PCT No.: PCT/JP03/03451

§ 371 (c)(1),
(2), (4) Date: Sep. 23, 2004

(87) PCT Pub. No.: WO03/081713

PCT Pub. Date: Oct. 2, 2003

(65) Prior Publication Data

US 2005/0104686 A1 May 19, 2005

(30) Foreign Application Priority Data

Mar. 25, 2002 (JP) ..... 2002-083248

(51) Int. Cl.
*H01Q 13/00* (2006.01)

(52) U.S. Cl. ..... 343/772; 343/840; 333/21; 333/135

(58) Field of Classification Search ..... 343/771, 343/772, 776, 786, 840; 333/21, 122, 126, 333/135

See application file for complete search history.

(56) References Cited

U.S. PATENT DOCUMENTS 5,726,667 A * 3/1998 Tamura ..... 343/786

(Continued)

FOREIGN PATENT DOCUMENTS

| | | |
|---|---|---|
| JP | 2-312302 A | 12/1990 |
| JP | 5-63407 A | 3/1993 |
| JP | 7-307604 A | 11/1995 |
| JP | 8-237003 A | 9/1996 |

(Continued)

OTHER PUBLICATIONS

Takashi Kitsuregawa, "Advanced Technology in Satellite Communication Antennas: Electrical and Mechanical Design", Artech House Inc., pp. 193-195, 1990.

*Primary Examiner*—Tan Ho

(57) ABSTRACT

The present invention includes: a first main waveguide 1; a T-branch circuit 3 connected thereto; a first low-pass filter 5 connected thereto; a band-pass filter 7 connected to the first T-branch circuit 3; a first converter 8 connected to the first low-pass filter 5 for converting transmission lines between a waveguide and a microwave integrated circuit; an amplifier 10 connected to the first converter and structured by the microwave integrated circuit; a second converter 9 connected thereto for converting transmission lines between a waveguide and the microwave integrated circuit; a second low-pass filter 6 connected thereto; a second T-branch circuit 4 connected to the second low-pass filter and the band-pass filter 7; and a second main waveguide 2 connected to the second T-branch circuit.

10 Claims, 19 Drawing Sheets

U.S. PATENT DOCUMENTS

| | | | | |
|---|---|---|---|---|
| 6,661,309 | B1 * | 12/2003 | Chen et al. | 333/126 |
| 2002/0011961 | A1 * | 1/2002 | Gomez-Henry et al. | 343/772 |
| 2003/0142027 | A1 * | 7/2003 | Moheb | 343/772 |

FOREIGN PATENT DOCUMENTS

| | | |
|---|---|---|
| JP | 2001-230603 A | 8/2001 |

* cited by examiner

HIGH FREQUENCY MODULE AND ANTENNA DEVICE

This application is a 371 of PCT/JP03/03451 filed Mar. 3, 2003.

TECHNICAL FIELD

The present invention relates to a high frequency module that is used mainly in VHF, UHF, microwave and millimeter wave bands, and more particularly to an antenna apparatus using the same.

BACKGROUND ART

FIG. 19 shows an arrangement of an antenna apparatus for shared use of left/right-handed circularly polarized waves and two frequency bands set forth, for example, in Takashi Kitsuregawa, "Advanced Technology in Satellite Communication Antennas: Electrical & Mechanical Design", ARTECH HOUSE INC., pp. 193–195, 1990.

In the figure, reference numeral 61 denotes a primary radiator for transmitting both left- and right-handed circularly polarized waves in a first frequency band to a main- or sub-reflector and for receiving both left- and right-handed circularly polarized waves in a second frequency band from the main- or sub-reflector; 62, a polarizer; 63, an orthomode transducer; 64*a* and 64*b*, diplexers; P1, an input terminal for radio waves in the first frequency band transmitted from the primary radiator 61 in a left-handed circular polarized wave; P2, an output terminal for radio waves in the second frequency band received by the primary radiator 61 in a left-handed circular polarized wave; P3, an input terminal for radio waves in the first frequency band transmitted from the primary radiator 61 in a right-handed circular polarized wave; and P4, an output terminal for radio waves in the second frequency band received by the primary radiator 61 in a right-handed circular polarized wave.

Next, an operation will be described.

Now, a linearly polarized radio wave in the first frequency band inputted from the input terminal P1 passes through the diplexer 64*a*, is inputted to the orthomode transducer 63 and is outputted as a vertically polarized wave. The vertically polarized wave is then converted by the polarizer 62 to a left-handed circularly polarized wave, passes through the primary radiator 61 and is radiated from the reflector into the air. Furthermore, a left-handed circularly polarized radio wave in the second frequency band received by the reflector passes through the primary radiator 61, is converted by the polarizer 62 to a vertically polarized wave, and is inputted to the orthomode transducer 63. The radio wave is then carried to the diplexer 64*a* and is extracted from the output terminal P2 as a linearly polarized wave.

In the meantime, a linearly polarized radio wave in the first frequency band inputted from the input terminal P3 passes through the diplexer 64*b*, is inputted to the orthomode transducer 63 and is outputted as a horizontally polarized wave. The horizontally polarized wave is then converted by the polarizer 62 to a right-handed circularly polarized wave, passes through the primary radiator 61 and is radiated from the reflector into the air. Furthermore, a right-handed circularly polarized radio wave in the second frequency band received by the reflector passes through the primary radiator 61, is converted by the polarizer 62 to a horizontally polarized wave, and is inputted to the orthomode transducer 63. The radio wave is then carried to the diplexer 64*b* and is extracted from the output terminal P4 as a linearly polarized wave.

Here, the radio waves in the first frequency band inputted from the input terminals P1 and P3 hardly leak into the output terminals P2 and P4 owing to isolation characteristics of the diplexers 64*a* and 64*b*. Furthermore, since the radio waves are converted by the orthomode transducer 63 into polarized waves which are mutually orthogonal, little interference occurs between the two radio waves. Accordingly, two transmission waves using the same frequency band and having both left- and right-handed circular polarized waves will be efficiently radiated from the primary radiator 61.

Moreover, two radio waves using the same frequency band and having both left- and right-handed circular polarized waves, received at the primary radiator 61, are converted into two linearly polarized waves which are mutually orthogonal without any interference therebetween and isolated by the polarizer 62 and the orthomode transducer 63. Furthermore, each isolated radio wave hardly leaks into the input terminals P1 and P3 owing to the isolation characteristics of the diplexers 64*a* and 64*b*. Accordingly, two transmission waves using the same frequency band and having differently rotating circular polarized waves will be efficiently outputted from the terminal 2 and the terminal 4.

In a conventional antenna apparatus, in order to efficiently extract the radio wave received at the reflector and to carry the extracted wave to a receiver connected to the output terminals P2 and P4, it has been necessary to suppress transmission loss along a path from the primary radiator 61 to the receiver as small as possible. This has resulted in a problem in that the primary radiator 61, the polarizer 62, the orthomode transducer 63, the diplexers 64*a* and 64*b* and the receiver must be located in proximity, which restricts flexibility of a configuration of those circuits.

Furthermore, in general, for machine-driven scanning of antenna beams, the primary radiator 61, the polarizer 62 and the orthomode transducer 63 rotate with the reflector. In this situation, because of the above-mentioned need for reduction of transmission loss, the diplexers 64*a* and 64*b* and the receiver must also be located at places where they rotate with the reflector. This has resulted in a problem in that a machine-driven part of the antenna apparatus grows large and heavy, and its rotating mechanism and rotation supporting mechanism grow large and heavy.

DISCLOSURE OF THE INVENTION

The present invention has been made in order to solve the problems mentioned above. An object of the invention is to obtain a high frequency module which enables an antenna apparatus to be made compact and lightweight and enhances flexibility of a configuration of constituent circuits, and a compact and lightweight antenna apparatus.

A high frequency module according to the present invention includes: a first main waveguide; a first T-branch circuit connected to the first main waveguide; a first low-pass filter connected to the first T-branch circuit for transmitting a first frequency band and reflecting a second frequency band; a band-pass filter connected to the first T-branch circuit for transmitting the second frequency band and reflecting the first frequency band; a first converter connected to the first low-pass filter for converting transmission lines between a waveguide and a microwave integrated circuit; an amplifier connected to the first converter and structured by the microwave integrated circuit; a second converter connected to the amplifier for converting transmission lines between a waveguide and the microwave integrated circuit; a second low-pass filter connected to the second converter for transmitting the first frequency band and reflecting the second frequency band; a second T-branch circuit connected to the second low-pass filter and the band-pass filter; and a second main waveguide connected to the second T-branch circuit.

A high frequency module according to the present invention includes: a first main waveguide; a first T-branch circuit connected to the first main waveguide; a first low-pass filter connected to the first T-branch circuit for transmitting a first frequency band and reflecting a second frequency band; a first band-pass filter connected to the first T-branch circuit and having a partially bent longitudinal axis for transmitting the second frequency band and reflecting the first frequency band; a first converter connected to the first low-pass filter for converting transmission lines between a waveguide and a microwave integrated circuit; an amplifier connected to the first converter and structured by the microwave integrated circuit; a second converter connected to the amplifier for converting transmission lines between a waveguide and the microwave integrated circuit; a second low-pass filter connected to the second converter for transmitting the first frequency band and reflecting the second frequency band; a first bend connected to the first band-pass filter; a second bend connected to the first bend; a second band-pass filter connected to the second bend and having a partially bent longitudinal axis for transmitting the second frequency band and reflecting the first frequency band; a second T-branch circuit connected to the second low-pass filter and the second band-pass filter; and a second main waveguide connected to the second T-branch circuit.

A high frequency module according to the present invention includes: a first main waveguide; a first T-branch circuit connected to the first main waveguide; a first band-pass filter connected to the first T-branch circuit for transmitting a first frequency band and reflecting a second frequency band; a second band-pass filter connected to the first T-branch circuit for transmitting the second frequency band and reflecting the first frequency band; a first converter connected to the first band-pass filter for converting transmission lines between a waveguide and a microwave integrated circuit; an amplifier connected to the first converter and structured by the microwave integrated circuit for converting transmission lines between a waveguide and the microwave integrated circuit; a second converter connected to the amplifier; a third band-pass filter connected to the second converter for transmitting the first frequency band and reflecting the second frequency band; a second T-branch circuit connected to the third band-pass filter and the second band-pass filter; and a second main waveguide connected to the second T-branch circuit.

A high frequency module according to the present invention includes: a first main waveguide; a first T-branch circuit connected to the first main waveguide; a first band-pass filter connected to the first T-branch circuit for transmitting a first frequency band and reflecting a second frequency band; a second band-pass filter connected to the first T-branch circuit and having a partially bent longitudinal axis for transmitting the second frequency band and reflecting the first frequency band; a first converter connected to the first band-pass filter for converting transmission lines between a waveguide and a microwave integrated circuit; an amplifier connected to the first converter and structured by the microwave integrated circuit; a second converter connected to the amplifier for converting transmission lines between a waveguide and the microwave integrated circuit; a third band-pass filter connected to the second converter for transmitting the first frequency band and reflecting the second frequency band; a first bend connected to the second band-pass filter; a second bend connected to the first bend; a fourth band-pass filter connected to the second bend and having a partially bent longitudinal axis for transmitting the second frequency band and reflecting the first frequency band; a second T-branch circuit connected to the third band-pass filter and the fourth band-pass filter; and a second main waveguide connected to the second T-branch circuit.

Further, the high frequency module includes a one-side corrugated rectangular waveguide low-pass filter as the waveguide band-pass filter.

Further, the high frequency module includes an inductive iris-coupled rectangular waveguide band-pass filter as the waveguide band-pass filter.

Further, the high frequency module is characterized in that the T-branch circuit is provided with a matching step at its branch point.

Further, the high frequency module is structured by combining two metal blocks to which the main waveguides, the T-branch circuits, the low-pass filters or the waveguide band-pass filters, the band-pass filter or the band-pass filters each having a partially bent longitudinal axis and the bends, and waveguide portions of the converters are bored.

Further, the high frequency module is characterized in that the amplifier has one metal plate thereon, and in a gap between the metal plate and an outer wall wider face of the amplifier, a one-side capacitive iris-coupled rectangular waveguide low-pass filter is provided, the waveguide inner walls of which include the metal plate and the outer wall wider face of the amplifier.

Further, the high frequency module is characterized in that the amplifier has one metal plate thereon, and in a gap between the metal plate and an outer wall wider face of the amplifier, a one-side corrugated rectangular waveguide low-pass filter is provided, the waveguide inner walls of which include the metal plate and the outer wall wider face of the amplifier.

An antenna apparatus according to the present invention includes: a primary radiator; an orthomode transducer connected to the primary radiator; any one of the above-mentioned first high frequency module, connected to the orthomode transducer; a first diplexer connected to the first high frequency module; any one of the above-mentioned second high frequency module, connected to the orthomode transducer; and a second diplexer connected to the second high frequency module.

An antenna apparatus according to the present invention includes: a primary radiator; a polarizer connected to the primary radiator; an orthomode transducer connected to the polarizer; any one of the above-mentioned first high frequency module, connected to the orthomode transducer; a first diplexer connected to the first high frequency module; any one of the above-mentioned second high frequency module, connected to the orthomode transducer; and a second diplexer connected to the second high frequency module.

BEST MODE FOR CARRYING OUT THE INVENTION

An embodiment of the present invention will be described below.

Embodiment 1.

Figure 1:
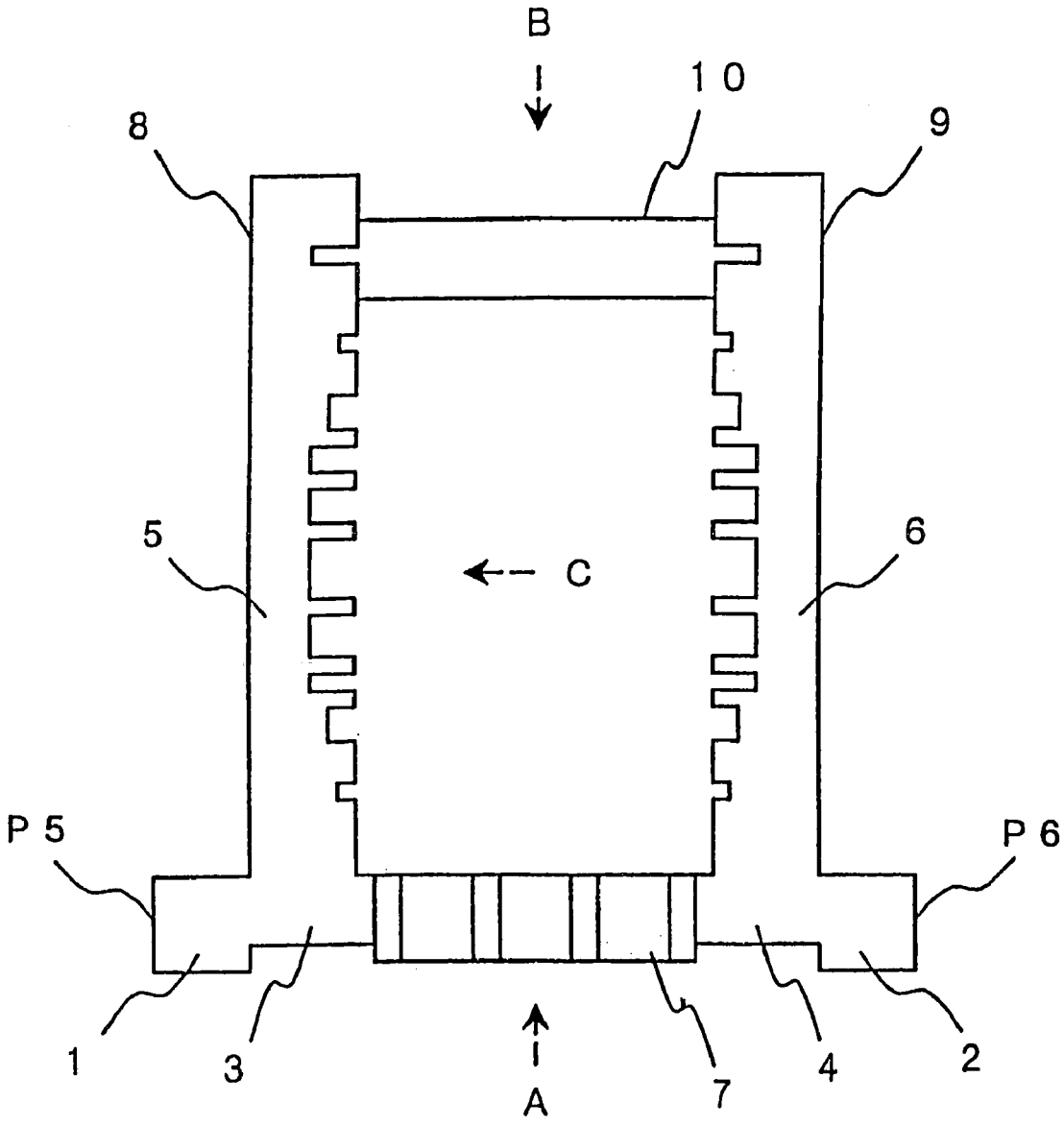
FIG. 1 is a top view showing an arrangement of a high frequency module in Embodiment 1 of the present invention.
Figure 2:
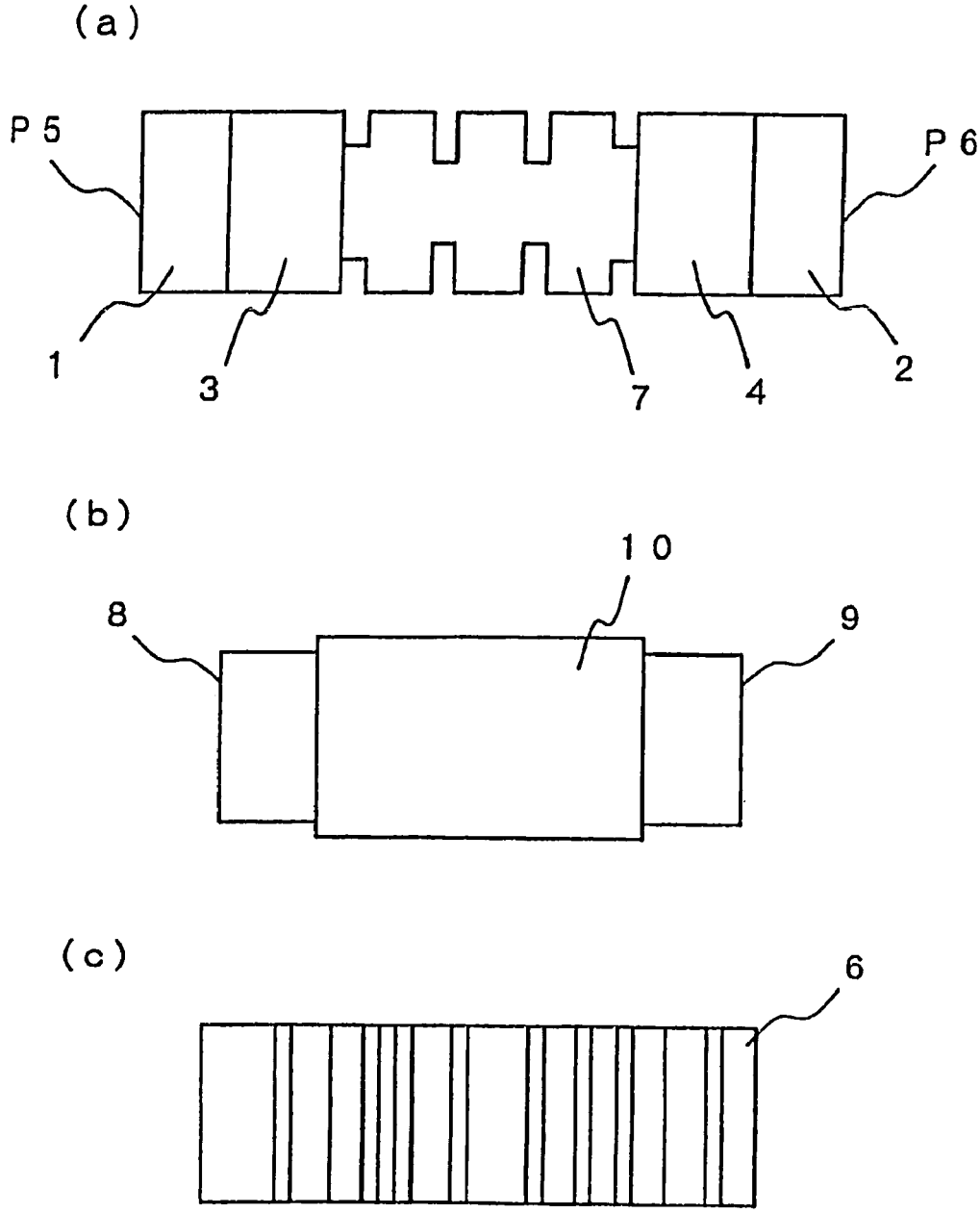
FIG. 2(*a*) is a side elevation viewed from a direction A of FIG. 1, FIG. 2(*b*) is a side elevation of a low noise amplifier viewed from a direction B of FIG. 1, and FIG. 2(*c*) is an internal side elevation viewed from a direction C of FIG. 1.

FIG. 1 is a top view showing an arrangement of a high frequency module in Embodiment 1 of the present invention, FIG. 2(*a*) is a side elevation viewed from a direction A of FIG. 1, FIG. 2(*b*) is a side elevation of a low noise amplifier viewed from a direction B of FIG. 1, and FIG. 2(*c*) is an internal side elevation viewed from a direction C of FIG. 1. In those figures, reference numeral 1 denotes a rectangular main waveguide (first main waveguide) in which high frequency radio waves are inputted/outputted from an input/output terminal P5 to be described below; 2, a rectangular main waveguide (second main waveguide) in which high frequency radio waves are inputted/outputted from an input/output terminal P6 to be described below; 3, an E-plane T-branch circuit (first T-branch circuit) of a stepped rectangular waveguide in which the E-planes of the rectangular waveguide each have a T-shape and its branch portion (branch point) is provided with a matching step; 4, an E-plane T-branch circuit (second T-branch circuit) of a stepped rectangular waveguide in which the E-planes of the rectangular waveguide each have a T-shape and its branch portion (branch point) is provided with a matching step; 5, a one-side corrugated rectangular waveguide low-pass filter (first low-pass filter) in which one of H-planes of the rectangular waveguide that faces a low-pass filter 6 to be described below is corrugated; 6, a one-side corrugated rectangular waveguide low-pass filter (second low-pass filter) in which one of the H-planes of the rectangular waveguide that faces the low-pass filter 5 is corrugated; 7, an inductive iris-coupled rectangular waveguide band-pass filter in which an iris is formed on inner sides of the E-planes of the rectangular waveguide; 8, a rectangular waveguide/MIC converter (first converter) for converting a transmission line for high frequency radio waves from a rectangular waveguide to a MIC (Microwave Intergrated Circuit), or from the MIC to the rectangular waveguide; 9, a rectangular waveguide/MIC converter (second converter) for converting a transmission line for high frequency waves from a rectangular waveguide to the MIC, or from the MIC to the rectangular waveguide; 10, a low noise amplifier (amplifier) made of the MIC; P5, an input/output terminal provided a tone end of the rectangular main waveguide 1; and P6, an input/output terminal provided at one end of the rectangular main waveguide 2. In addition, the matching step described above is a matching rectangular waveguide one-side E-plane step which forms a stair-like step on the E-plane in the waveguide.

In addition, the input/output terminal P5 is provided at a first port of the E-plane T-branch circuit 3, the band-pass filter 7 is provided at a second port that faces the first port, and the low-pass filter 5 is provided at a third port that is branched from the branch portion (branch point) between the first port and the second port. In other words, the input/output terminal P5 and the band-pass filter 7 are located in a straight line.

Similarly, the input/output terminal P6 is provided at a first port of the E-plane T-branch circuit 4, the band-pass filter 7 is provided at a second port that faces the first port, and the low-pass filter 6 is provided at a third port that is branched from the branch portion (branch point) between the first port and the second port. In other words, the input/output terminal P6 and the band-pass filter 7 are located in a straight line.

In addition, the low-pass filters 5 and 6 are designed to transmit radio waves in a first frequency band and to reflect radio waves in a second frequency band which is a higher frequency band than the first frequency band. Furthermore, the band-pass filter 7 is designed to transmit radio waves in the second frequency band and to reflect radio waves in the first frequency band.

Moreover, the E-plane T-branch circuit 3 is provided, at the branch portion (branch point), with the matching step designed so that a reflected wave produced when a radio wave in the first frequency band is incident on the main waveguide 1 side and a reflected wave produced when a radio wave in the second frequency band is incident on the band-pass filter 7 side are reduced, respectively. Furthermore, the E-plane T-branch circuit 4 is provided, at the branch portion (branch point), with the matching step designed so that a reflected wave produced when a radio wave in the first frequency band is incident on the low-pass filter 6 side and a reflected wave produced when a radio wave in the second frequency band is incident on the main waveguide 1 side are reduced, respectively.

Next, an operation will be described.

First, when a fundamental mode (rectangular waveguide TE01 mode) of a radio wave in the first frequency band is inputted from the input/output terminal P5, this radio wave propagates through the main waveguide 1, the E-plane T-branch circuit 3 and the low-pass filter 5 and enters the low noise amplifier 10 from the converter 8. Then, after the radio wave is amplified in the low noise amplifier 10, the wave exits from the converter 9, propagates through the low-pass filter 6, the E-plane T-branch circuit 4 and the main waveguide 2 and is outputted from the input/output terminal P6 as the fundamental mode of the rectangular waveguide. On the other hand, even if the fundamental mode of the radio wave in the first frequency band is incident from the E-plane T-branch circuit 3 on the band-pass filter 7, the radio wave is reflected by the band-pass filter 7, and hence does not propagate through the path of the E-plane T-branch circuit 3, the band-pass filter 7 and the E-plane T-branch circuit 3.

Next, suppose a fundamental mode (rectangular waveguide TE01 mode) of a radio wave in the second frequency band, which is a higher frequency band than the first frequency band, is inputted from the input/output terminal P6. This radio wave propagates through the main waveguide 2, the E-plane T-branch circuit 4, the band-pass filter 7, the E-plane T-branch circuit 2 and the main waveguide 1, and is outputted from the input/output terminal P5 as a fundamental mode of the rectangular waveguide. On the other hand, even if the fundamental mode of the radio wave in the second frequency band is incident from the E-plane T-branch circuit 4 on the low-pass filter 6, the radio wave is reflected by the low-pass filter 6, and hence does not propagate through the path of the E-plane T-branch circuit 4, the low-pass filter 6, the converter 9, the low noise amplifier 10, the converter 8, the low-pass filter 5 and the E-plane T-branch circuit 3.

Therefore, a radio wave in the first frequency band inputted from the input/output terminal P5 is efficiently inputted to the low noise amplifier 10 while suppressing reflection to the input/output terminal P5 and direct leakage into the E-plane T-branch circuit 4 side. Moreover, the radio wave in the first frequency band amplified by the low noise amplifier 10 is efficiently outputted from the input/output terminal P6 without regressing to the E-plane T-branch circuit 3 side. Furthermore, a radio wave in the second frequency band inputted from the input/output terminal P5 is efficiently outputted from the input/output terminal P5 while suppressing reflection to the input/output terminal P6 and leakage into the low noise amplifier 10 side.

In this way, according to this Embodiment 1, the rectangular waveguide E-plane T-branch circuit 3 connects to the low-pass filter 5 and the band-pass filter 7, the low-pass filter 5 connects to the rectangular waveguide/MIC converter 8, the rectangular waveguide/MIC converter 8 connects to the low noise amplifier 10, the low noise amplifier 10 connects to the rectangular waveguide/MIC converter 9, the rectangular waveguide/MIC converter 9 connects to the low-pass filter 6, and the low-pass filter 6 and the band-pass filter 7 connect to the rectangular waveguide E-plane T-branch circuit 4. This provides an effect in that radio waves in the first frequency band inputted from the input/output terminal P5 can be efficiently amplified and passed without causing oscillation, and that, at the same time, radio waves in the second frequency band inputted from the input/output terminal P6 can be passed with little loss.

Further, if the number of resonator stages of the band-pass filter 7 is decreased as appropriate, a distance between the input/output terminal P5 and the input/output terminal P6 is reduced. This provides an effect of being capable of obtaining a high frequency module which can be made compact and lightweight and which has high performance.

Embodiment 2.

Figure 3:
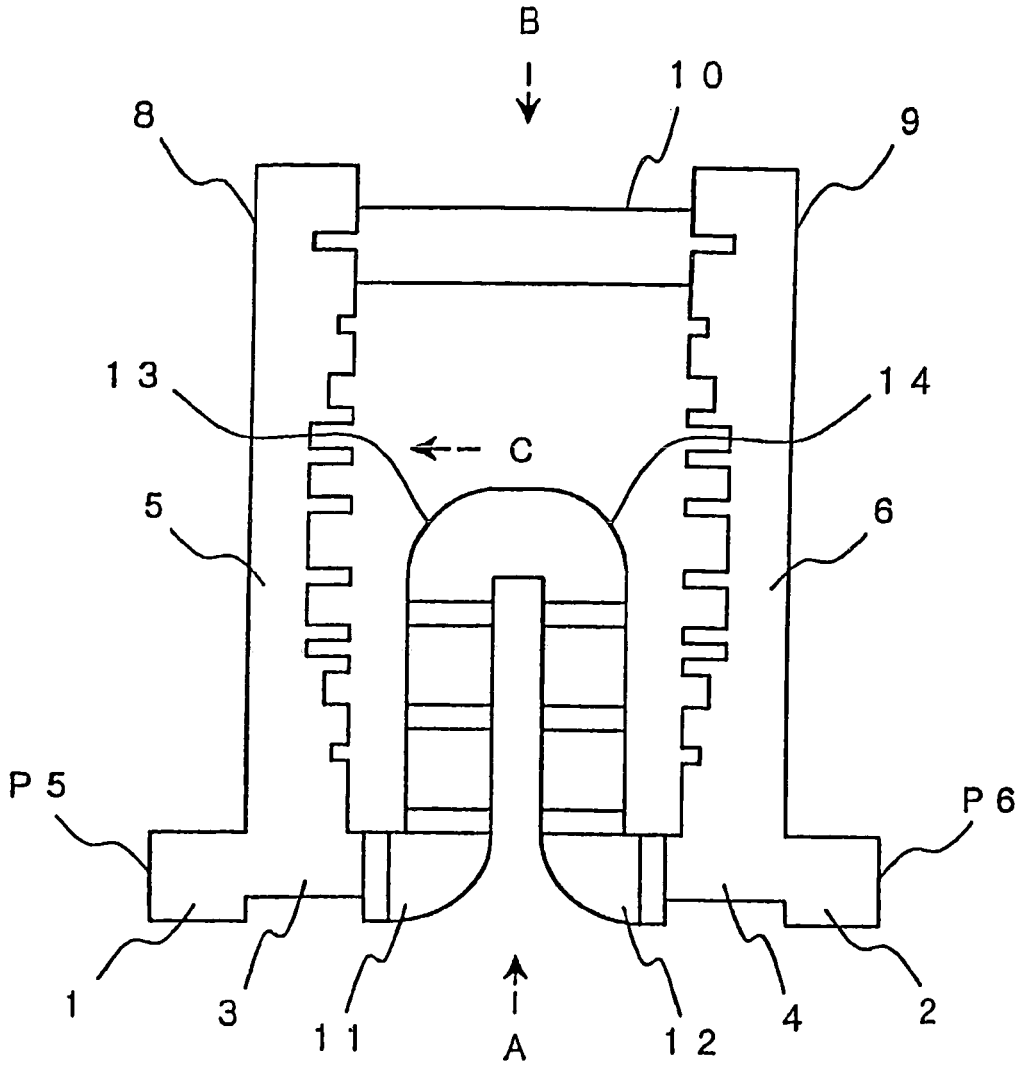
FIG. 3 is a top view showing an arrangement of a high frequency module according to Embodiment 2 of the present invention.
Figure 4:
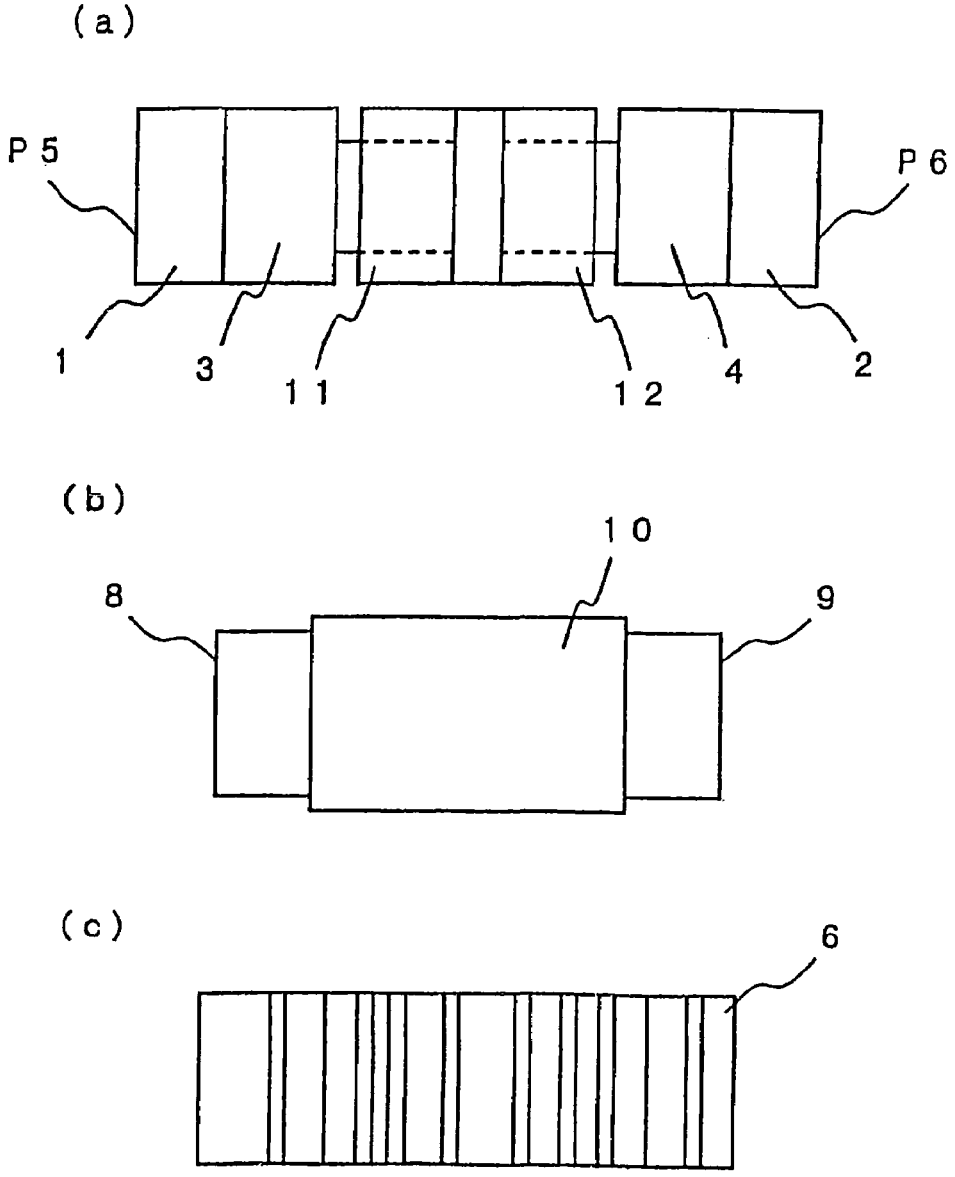
FIG. 4(*a*) is a side elevation viewed from a direction A of FIG. 3, FIG. 4(*b*) is a side elevation of a low noise amplifier viewed from a direction B of FIG. 3, and FIG. 4(*c*) is an internal side elevation viewed from a direction C of FIG. 3.

FIG. 3 is a top view showing an arrangement of a high frequency module according to Embodiment 2 of the present invention, FIG. 4(*a*) is a side elevation viewed from a direction A of FIG. 3, FIG. 4(*b*) is a side elevation of a low noise amplifier viewed from a direction B of FIG. 3, and FIG. 4(*c*) is an internal side elevation viewed from a direction C of FIG. 3.

In Embodiment 1 described above, the band-pass filter 7 is illustratively connected to the rectangular waveguide E-plane T-branch circuits 3 and 4. As shown in FIG. 3, however, the band-pass filter 7 is replaced by an inductive iris-coupled rectangular waveguide band-pass filter 11 (first band-pass filter) which is connected to the E-plane T-branch circuit 3 and which has a partially bent longitudinal axis, a rectangular waveguide E-plane bend 13 (first bend) connected to the band-pass filter 11, a rectangular waveguide E-plane bend 14 (second bend) connected to the rectangular waveguide E-plane bend 13, and an inductive iris-coupled rectangular waveguide band-pass filter 12 (second band-pass filter) which is connected to the rectangular waveguide E-plane bend 14 and which has a partially bent longitudinal axis. Note that, an operation is not described because the operation is similar to that of Embodiment 1.

In this way, since the high frequency module in this embodiment is arranged as described above, the high frequency module provides an effect similar to that of Embodiment 1.

Furthermore, if the number of resonator stages constituting the band-pass filters 11 and 12 is increased in an upward direction of FIG. 3, that is, in a direction in which the low noise amplifier 10 is placed, then an effect is provided in that the amount of radio waves in the first frequency band that directly leaks from the E-plane T-branch circuit 3 into the E-plane T-branch circuit 4 can be significantly reduced without changing a distance between the input/output terminal P5 and the input/output terminal P6.

Moreover, by appropriately determining a distance between the band-pass filters 11, 12 and the E-plane bends 13, 14, another effect is provided in that a superior reflection characteristic can be obtained in the second frequency band without changing the distance between the input/output terminal P5 and the input/output terminal P6. There is still another effect of increasing design flexibility.

Embodiment 3.

Figure 5:
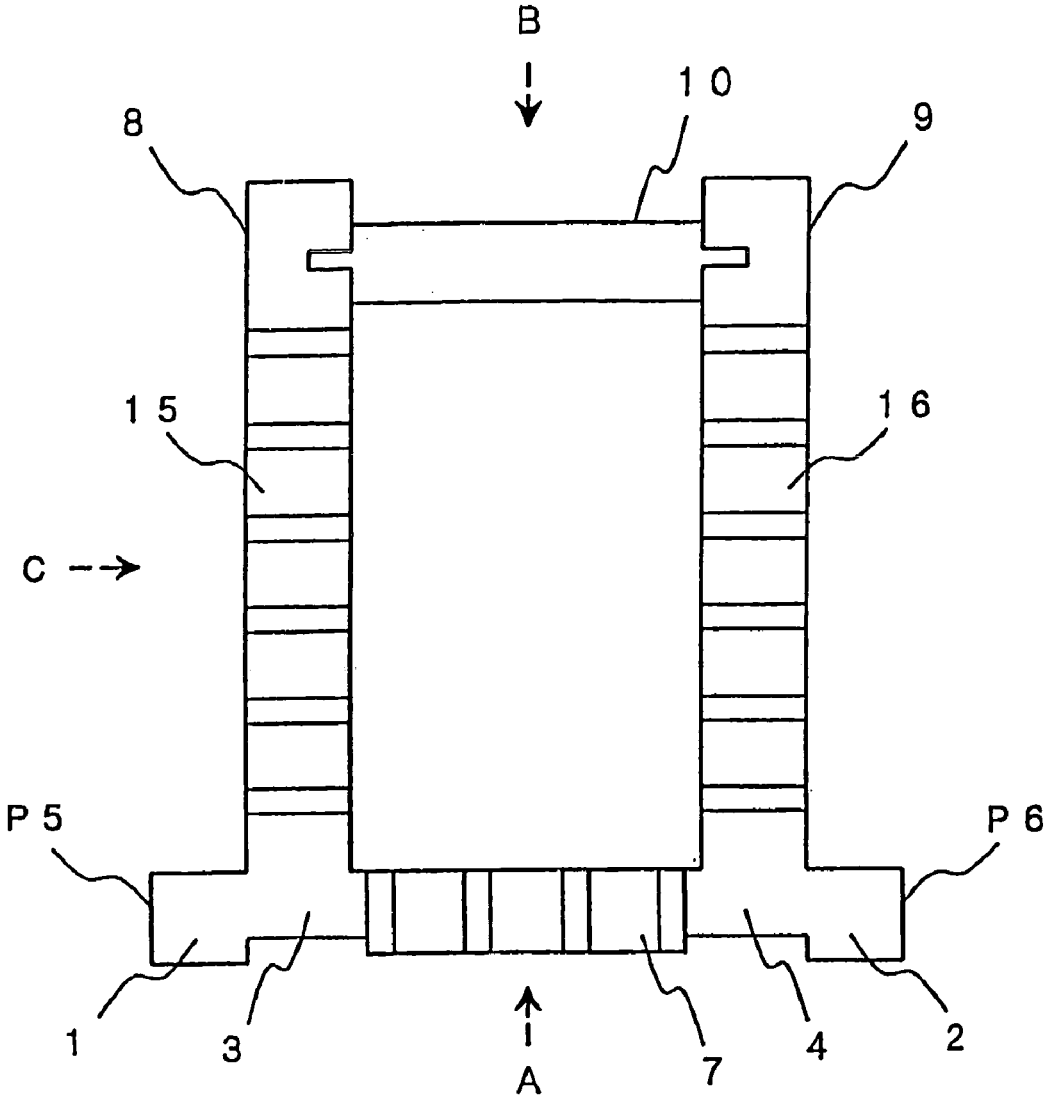
FIG. 5 is a top view showing an arrangement of a high frequency module according to Embodiment 3 of the present invention.
Figure 6:
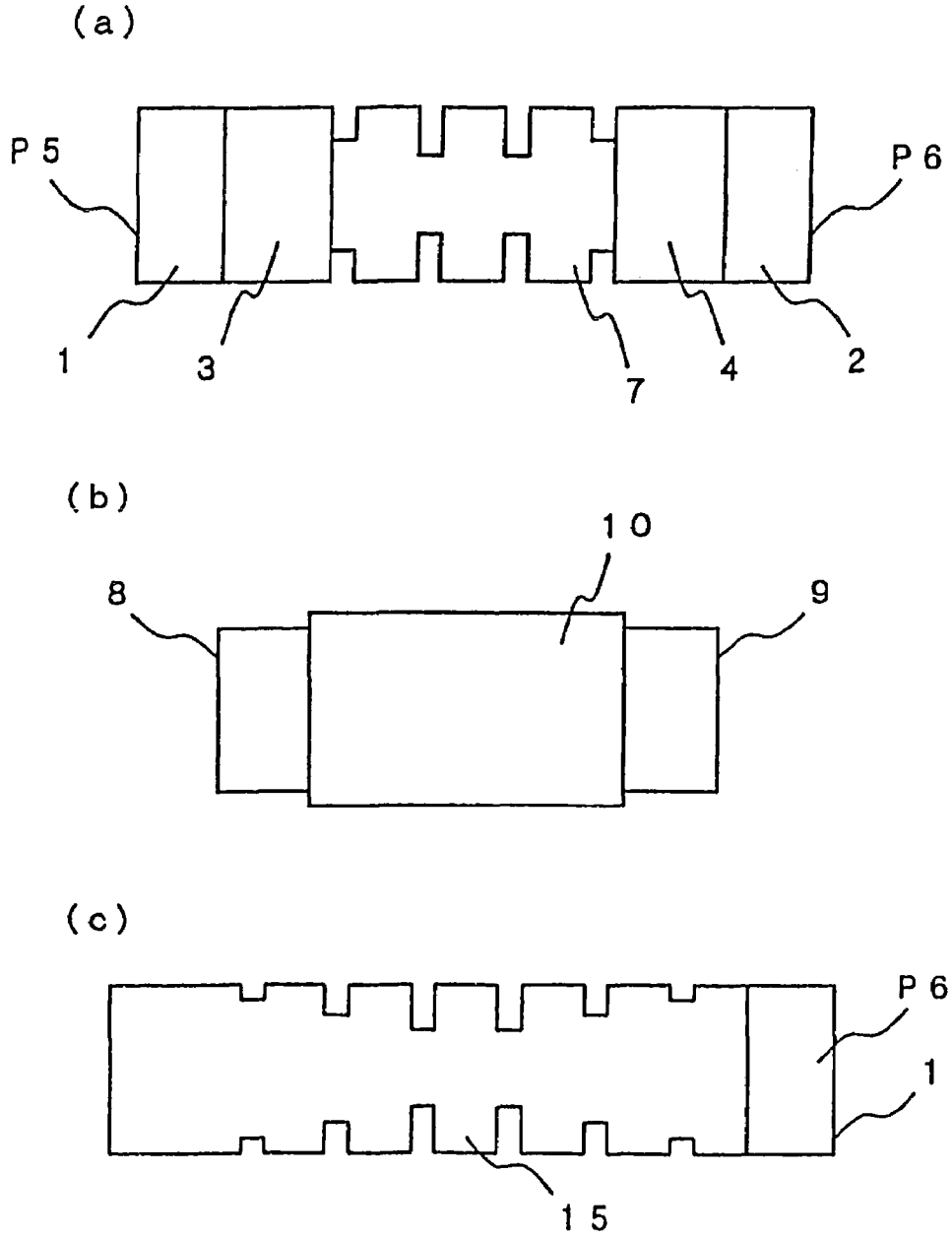
FIG. 6(*a*) is a side elevation viewed from a direction A of FIG. 5, FIG. 6(*b*) is a side elevation of a low noise amplifier viewed from a direction B of FIG. 5, and FIG. 6(*c*) is a side elevation viewed from a direction C of FIG. 5.

FIG. 5 is a top view showing an arrangement of a high frequency module according to Embodiment 3 of the present invention, FIG. 6(*a*) is a side elevation viewed from a direction A of FIG. 1, FIG. 6(*b*) is a side elevation of a low noise amplifier viewed from a direction B of FIG. 5, and FIG. 6(*c*) is a side elevation viewed from a direction C of FIG. 5. In Embodiment 1 described above, the low-pass filters 5 and 6 are illustratively connected to the rectangular waveguide E-plane T-branch circuits 3 and 4. As shown in FIG. 5, however, the low-pass filters 5 and 6 are replaced by inductive iris-coupled rectangular waveguide band-pass filters 15 and 16 (first band-pass filter and third band-pass filter). Note that the band-pass filter 7 corresponds to the second band-pass filter.

Here, the inductive iris-coupled rectangular waveguide band-pass filters 15 and 16 used in Embodiment 3 each have a structure similar to that of the inductive iris-coupled rectangular waveguide band-pass filter 7 used in Embodiment 1.

Note that, an operation is not described because the operation is similar to that of Embodiment 1.

In this way, since the high frequency module in this embodiment is arranged as described above, the high frequency module provides an effect similar to that of Embodiment 1. Moreover, even if a spacing between the first frequency band and the second frequency band is narrow, an effect is provided in that the amount of radio waves in the second frequency band that leaks into the low noise amplifier 10 side can be significantly reduced.

Embodiment 4.

Figure 7:
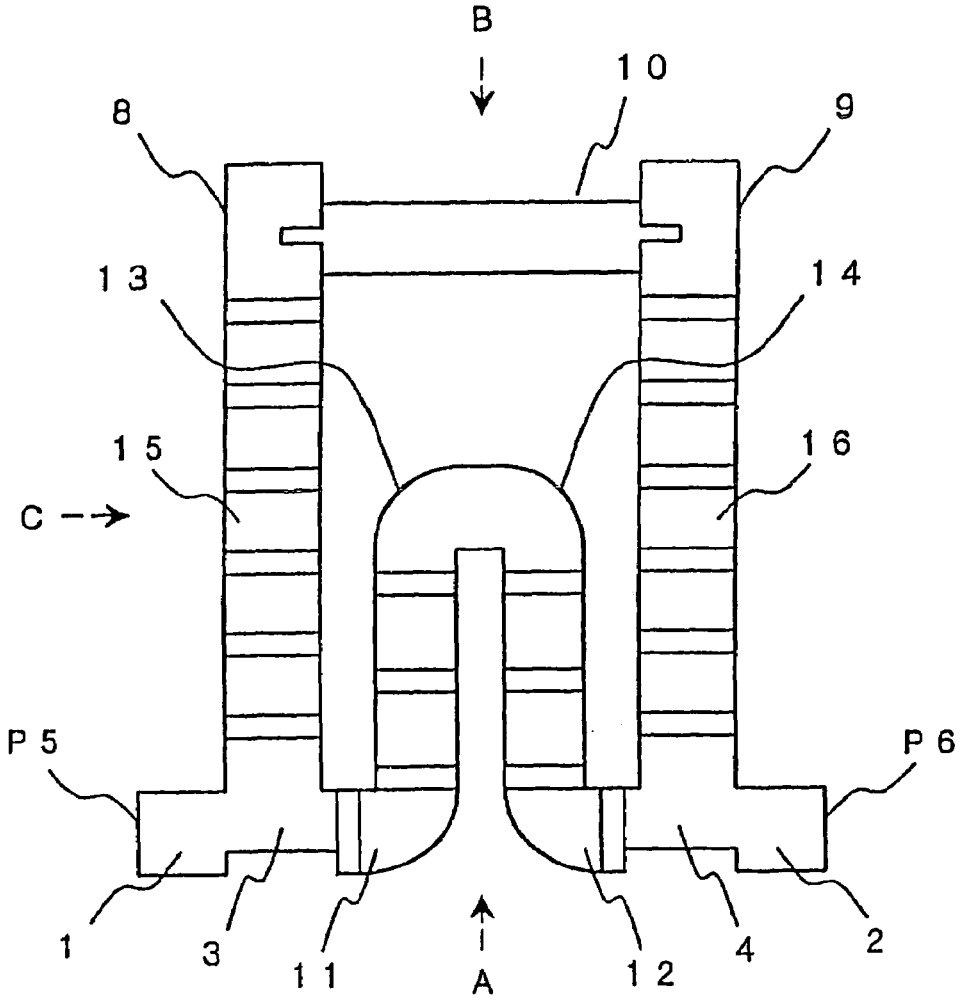
FIG. 7 is a top view showing an arrangement of a high frequency module according to Embodiment 4 of the present invention.
Figure 8:
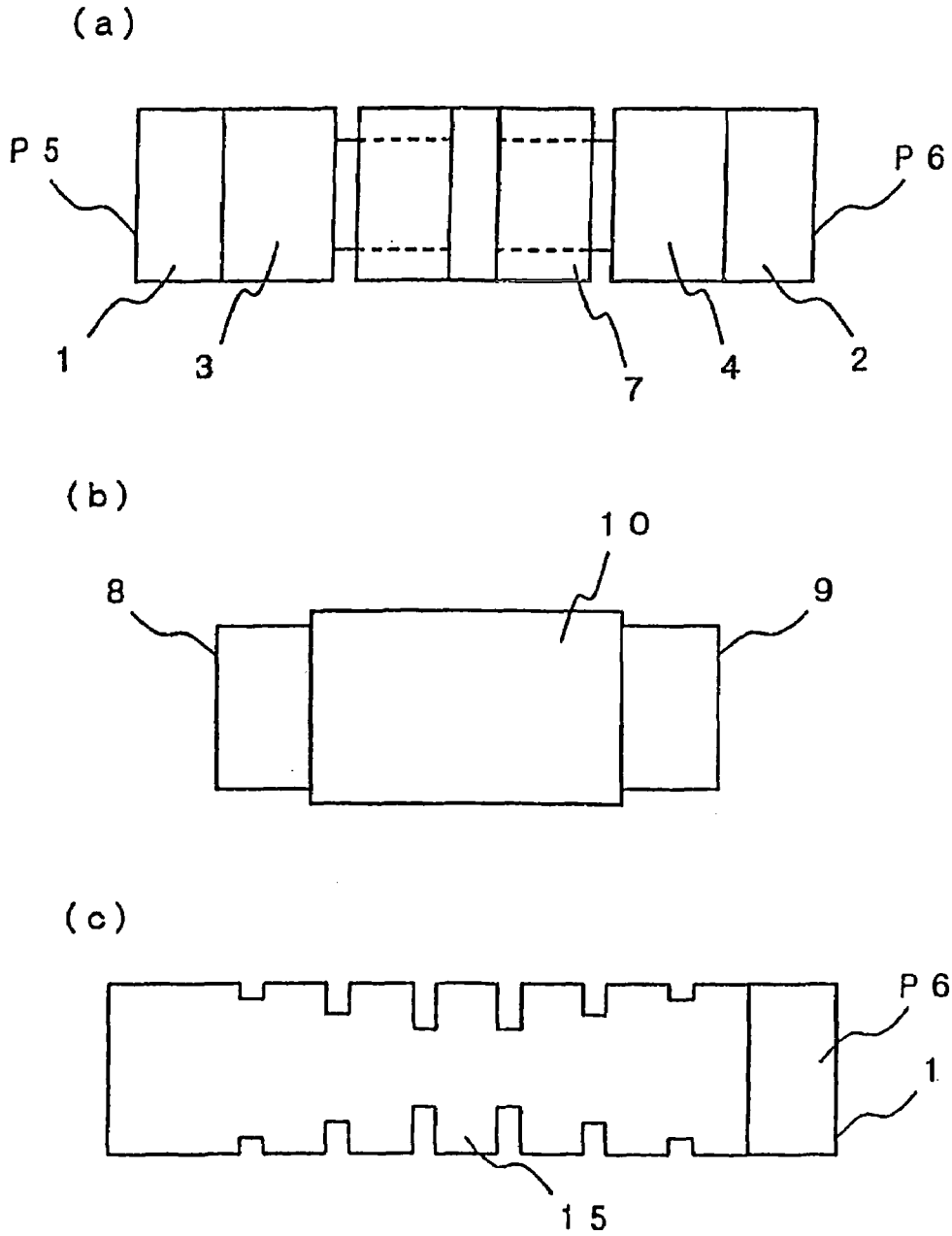
FIG. 8(*a*) is a side elevation viewed from a direction A of FIG. 7, FIG. 8(*b*) is a side elevation of a low noise amplifier viewed from a direction B of FIG. 7, and FIG. 8(*c*) is a side elevation viewed from a direction C of FIG. 7.

FIG. 7 is a top view showing an arrangement of a high frequency module according to Embodiment 4 of the present invention, FIG. 8(*a*) is a side elevation viewed from a direction A of FIG. 7, FIG. 8(*b*) is a side elevation of a low noise amplifier viewed from a direction B of FIG. 7, and FIG. 8(*c*) is a side elevation viewed from a direction C of FIG. 7. In Embodiment 1 described above, the low-pass filters 5 and 6 and the band-pass filter 7 are illustratively connected to the rectangular waveguide E-plane T-branch circuits 3 and 4. As shown in FIG. 7, however, the low-pass filters 5 and 6 are replaced by the inductive iris-coupled rectangular waveguide band-pass filters 15 and 16 (first band-pass filter and third band-pass filter). In addition, the band-pass filter 7 is replaced by an inductive iris-coupled rectangular waveguide band-pass filter 11 (second band-pass filter) which is connected to the E-plane T-branch circuit 3 and which has a partially bent longitudinal axis, a rectangular waveguide E-plane bend 13 connected to the band-pass filter 11, a rectangular waveguide E-plane bend 14 connected to the rectangular waveguide E-plane bend 13, and an inductive iris-coupled rectangular waveguide band-pass filter 12 (fourth band-pass filter) which is connected to the rectangular waveguide E-plane bend 14 and which has a partially bent longitudinal axis.

In this way, since the high frequency module in this embodiment is arranged as described above, the high frequency module provides an effect similar to that of Embodiment 1. Moreover, even if the spacing between the first frequency band and the second frequency band is narrow, an effect is provided in that the amount of radio waves in the second frequency band that leaks into the low noise amplifier 10 side can be significantly reduced.

Furthermore, if the number of resonator stages constituting the band-pass filters 11 and 12 is increased in an upward direction of FIG. 7, that is, in a direction in which the low noise amplifier 10 is placed, then an effect is provided in that the amount of radio waves in the first frequency band that directly leaks from the E-plane T-branch circuit 3 into the E-plane T-branch circuit 4 can be significantly reduced without changing the distance between the input/output terminal P5 and the input/output terminal P6.

Moreover, by appropriately determining the distance between the band-pass filters 11, 12 and the E-plane bends 13, 14, another effect is provided in that a superior reflection characteristic can be obtained in the second frequency band without changing the distance between the input/output terminal P5 and the input/output terminal P6.

Embodiment 5.

Figure 9:
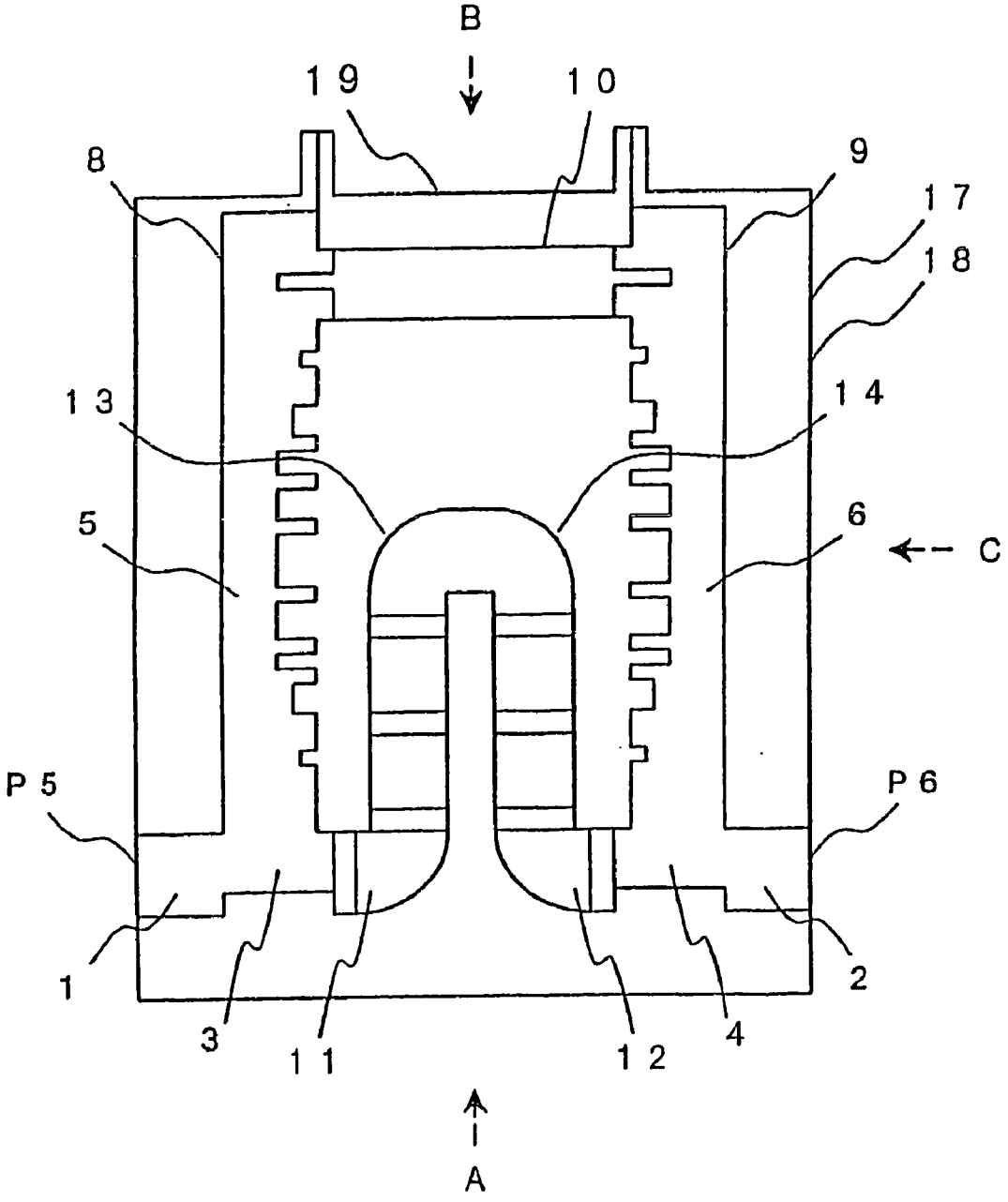
FIG. 9 is a top view showing an assembled arrangement of a high frequency module of the above-described Embodiment 2 of the invention according to Embodiment 5 of the present invention.
Figure 10:
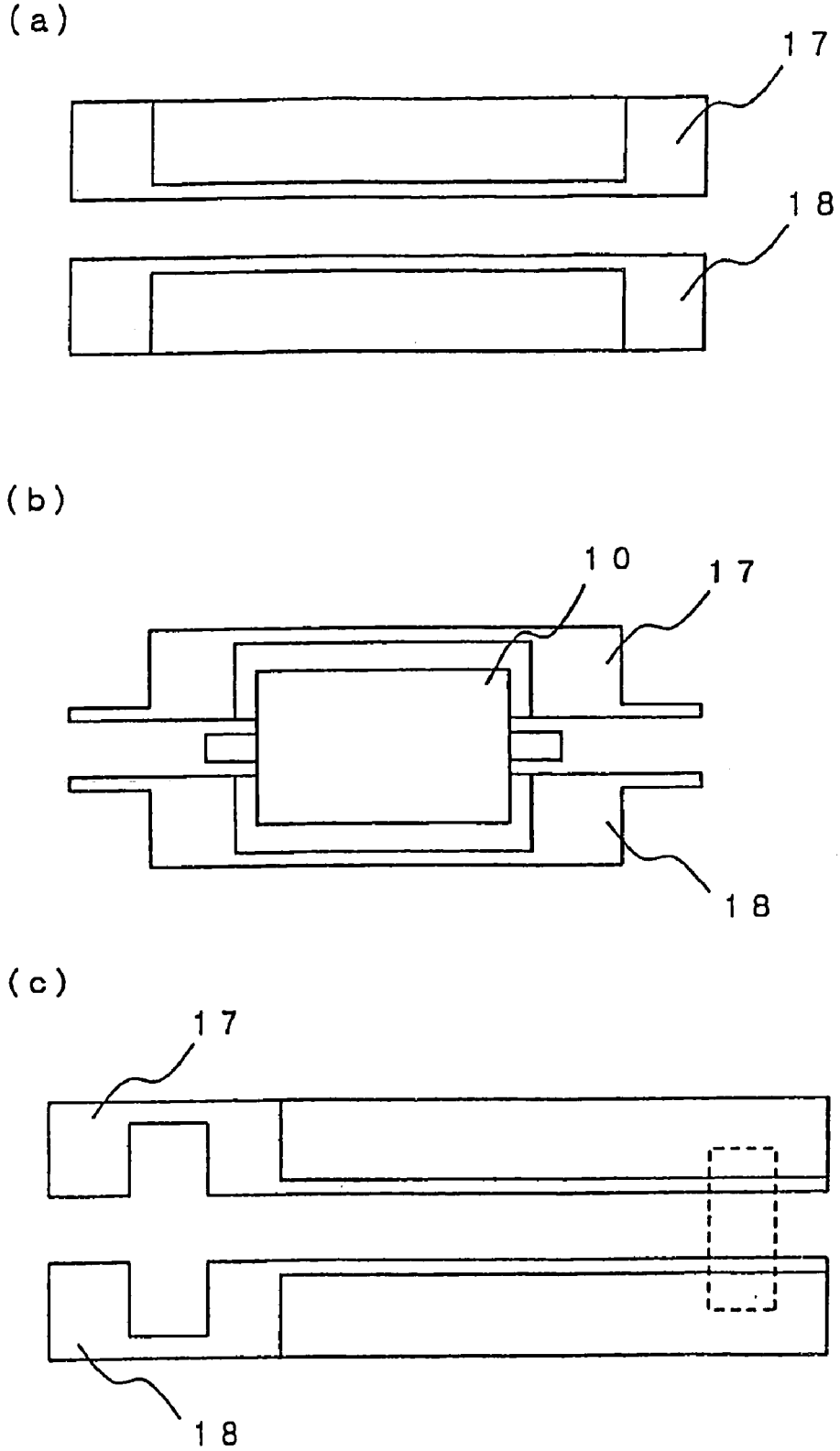
FIG. 10(*a*) is a side elevation viewed from a direction A of FIG. 8, FIG. 10(*b*) is a side elevation viewed from a direction B of FIG. 8, and FIG. 10(*c*) is a side elevation viewed from a direction C of FIG. 8.

FIG. 9 is a top view showing an assembled arrangement of the high frequency module of the above-described Embodiment 2 of the invention according to Embodiment 5 of the present invention, FIG. 10(*a*) is a side elevation viewed from a direction A of FIG. 8, FIG. 10(*b*) is a side elevation viewed from a direction B of FIG. 8, and FIG. 10(*c*) is a side elevation viewed from a direction C of FIG. 8. In those figures, reference numeral 17 denotes a bisected waveguide metal block realized in an integral structure by boring one metal block to form upper portions of E-plane symmetric partitions of the main waveguides 1 and 2, the T-branch circuits 3 and 4, the low-pass filters 5 and 6, the waveguide portions of the waveguide/MIC converters 8 and 9, the band-pass filters 11 and 12, and the waveguide bends 13 and 14; 18, a bisected waveguide metal block realized in an integral structure by boring one metal block to form lower portions of E-plane symmetric partitions of the main waveguides 1 and 2, the T-branch circuits 3 and 4, the low-pass filters 5 and 6, the waveguide portions of the waveguide/MIC converters 8 and 9, the band-pass filters 11 and 12, and the waveguide bends 13 and 14; 19, a metal plate for locating and supporting the low noise amplifier 10 in the metal blocks 17 and 18.

Note that, an operation is not described because the operation is similar to that of Embodiment 2.

In this way, according to this Embodiment 5, the high frequency module is arranged by combining the metal blocks 17 and 18, each integrally forming the main waveguides 1 and 2, the T-branch circuits 3 and 4, the low-pass filters 5 and 6, the waveguide portions of the waveguide/MIC converters 8 and 9, the band-pass filters 11 and 12, and the waveguide bends 13 and 14. This provides an effect, in addition to the effect of Embodiment 2, in that connection supporting mechanisms such as flanges, usually needed to interconnect waveguide circuits, are significantly reduced, which enables a more compact and lightweight, and high-performance high frequency module to be obtained.

Embodiment 6.

Figure 11:
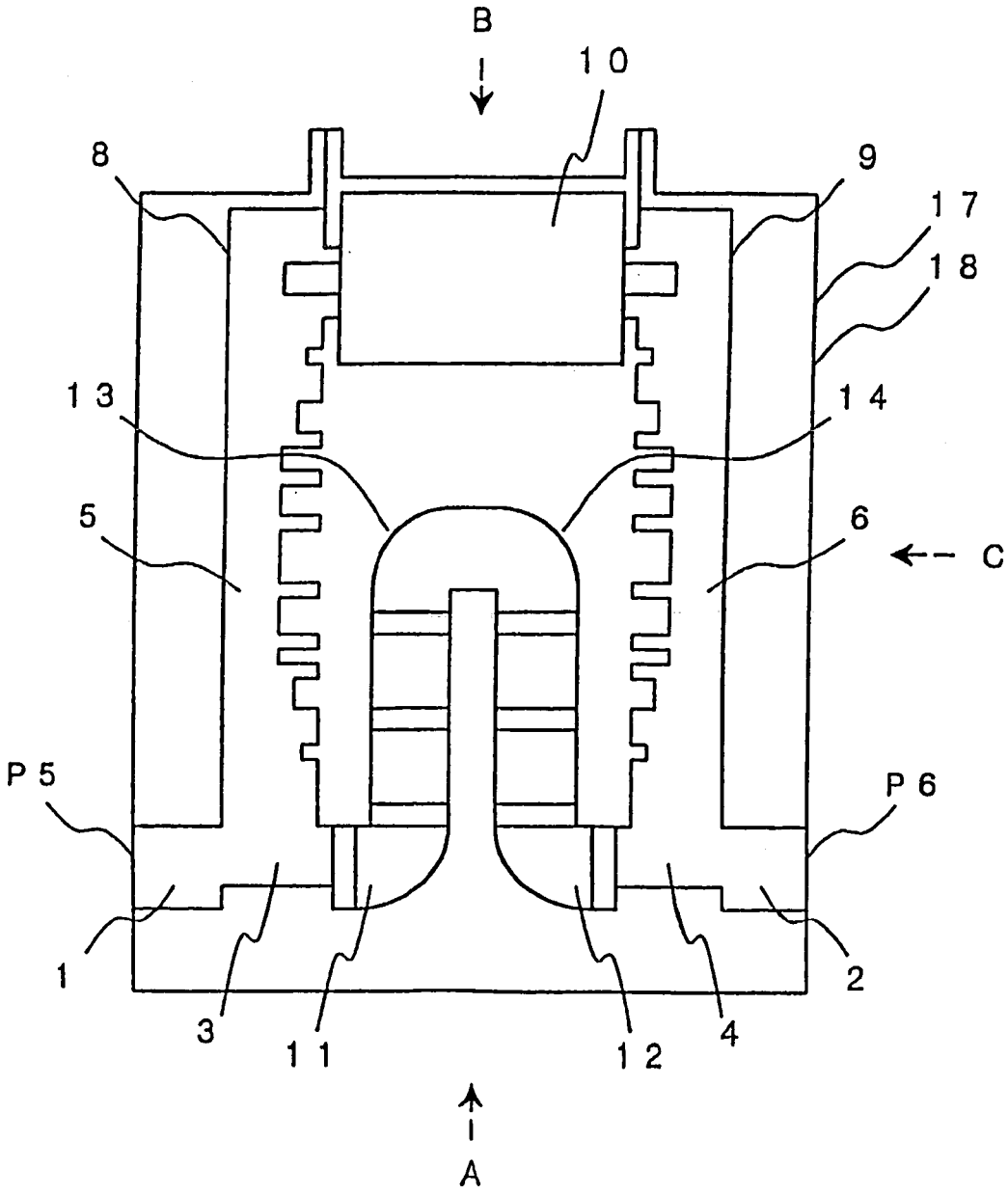
FIG. 11 is a top view showing an arrangement of a high frequency module according to Embodiment 6 of the present invention.
Figure 12:
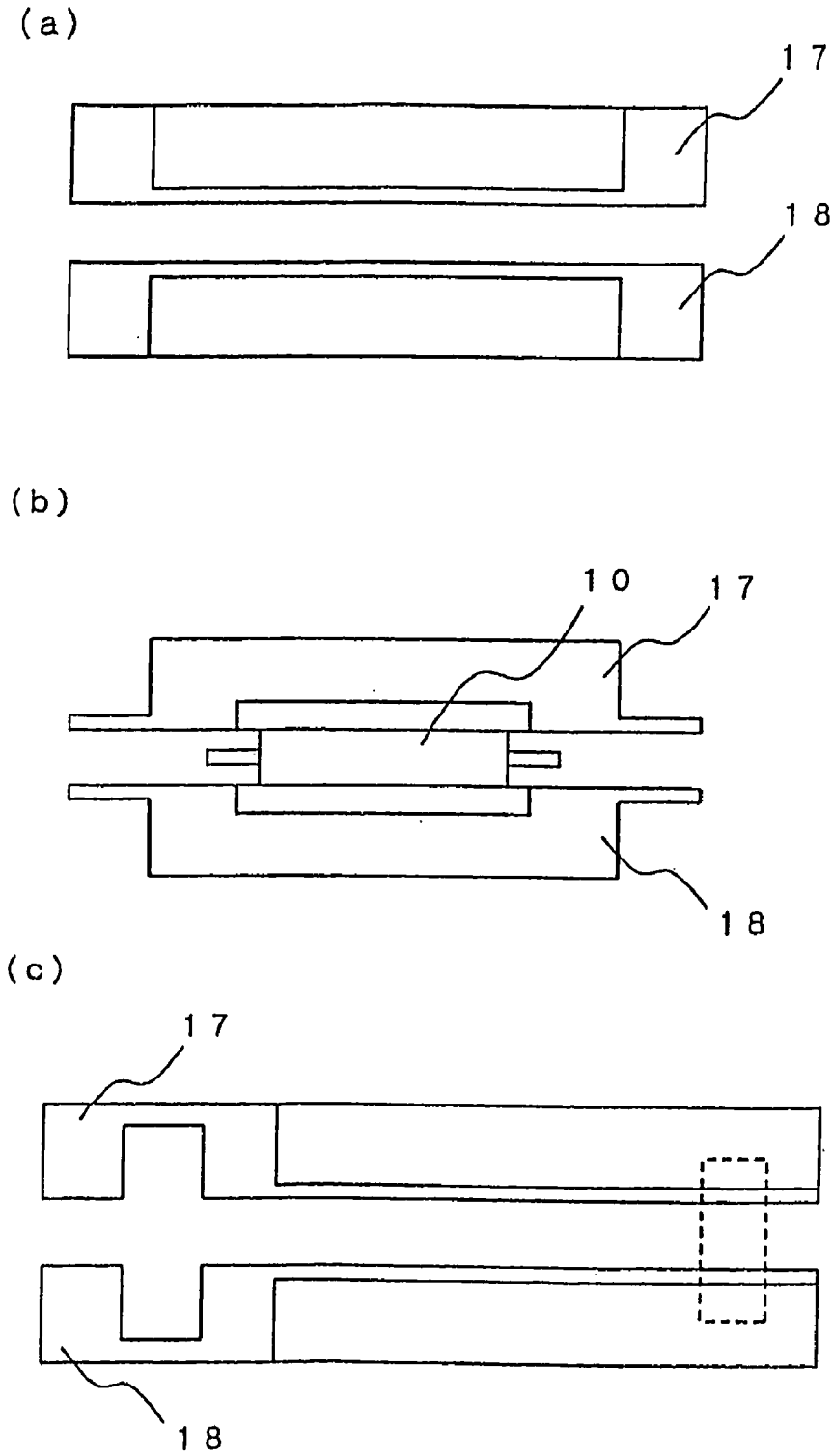
FIG. 12(*a*) is a side elevation viewed from a direction A of FIG. 11, FIG. 12(*b*) is a side elevation viewed from a direction B of FIG. 11, and FIG. 12(*c*) is a side elevation viewed from a direction C of FIG. 11.

FIG. 11 is a top view showing an arrangement of a high frequency module according to Embodiment 6 of the present invention, FIG. 12(*a*) is a side elevation viewed from a direction A of FIG. 11, FIG. 12(*b*) is a side elevation viewed from a direction B of FIG. 11, and FIG. 12(*c*) is a side elevation viewed from a direction C of FIG. 11. In Embodiment 5 described above, wider faces of the low noise amplifier 10 are illustratively grounded on combining faces of the metal blocks 17 and 18. In this embodiment, however, as shown in FIG. 11, narrower faces of the low noise amplifier 10 are placed on the combining faces of the metal blocks 17 and 18.

Note that, an operation is not described because the operation is similar to that of Embodiment 2.

In this way, since the high frequency module in this embodiment is arranged as described above, the high frequency module provides an effect, similar to that of Embodiment 5, in that connection supporting mechanisms such as flanges, usually needed to interconnect waveguide circuits, are significantly reduced, which enables a more compact and lightweight, and high-performance high frequency module to be obtained.

Embodiment 7.

Figure 13:
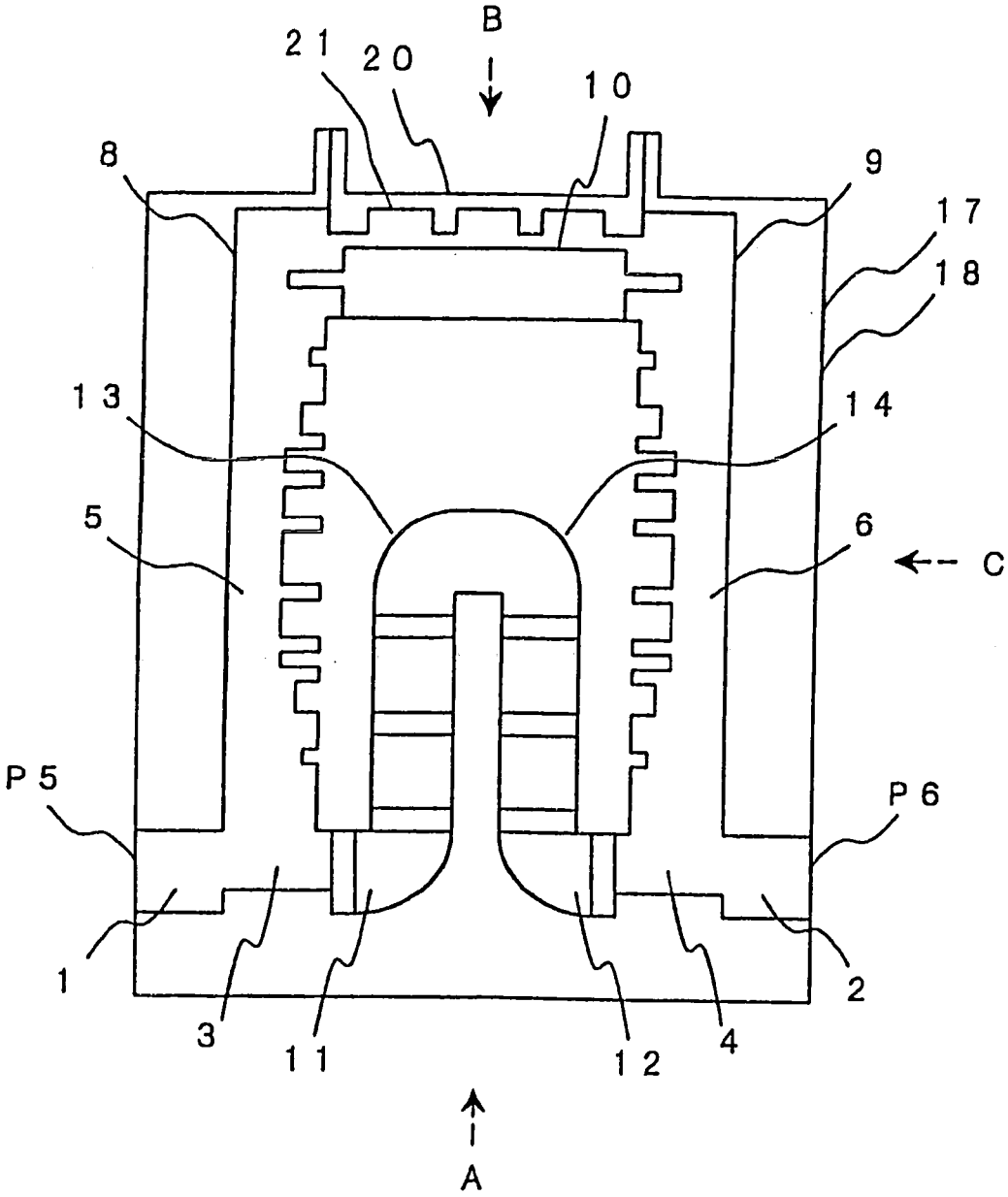
FIG. 13 is a cross sectional view showing an arrangement of a high frequency module according to Embodiment 7 of the present invention.
Figure 14:
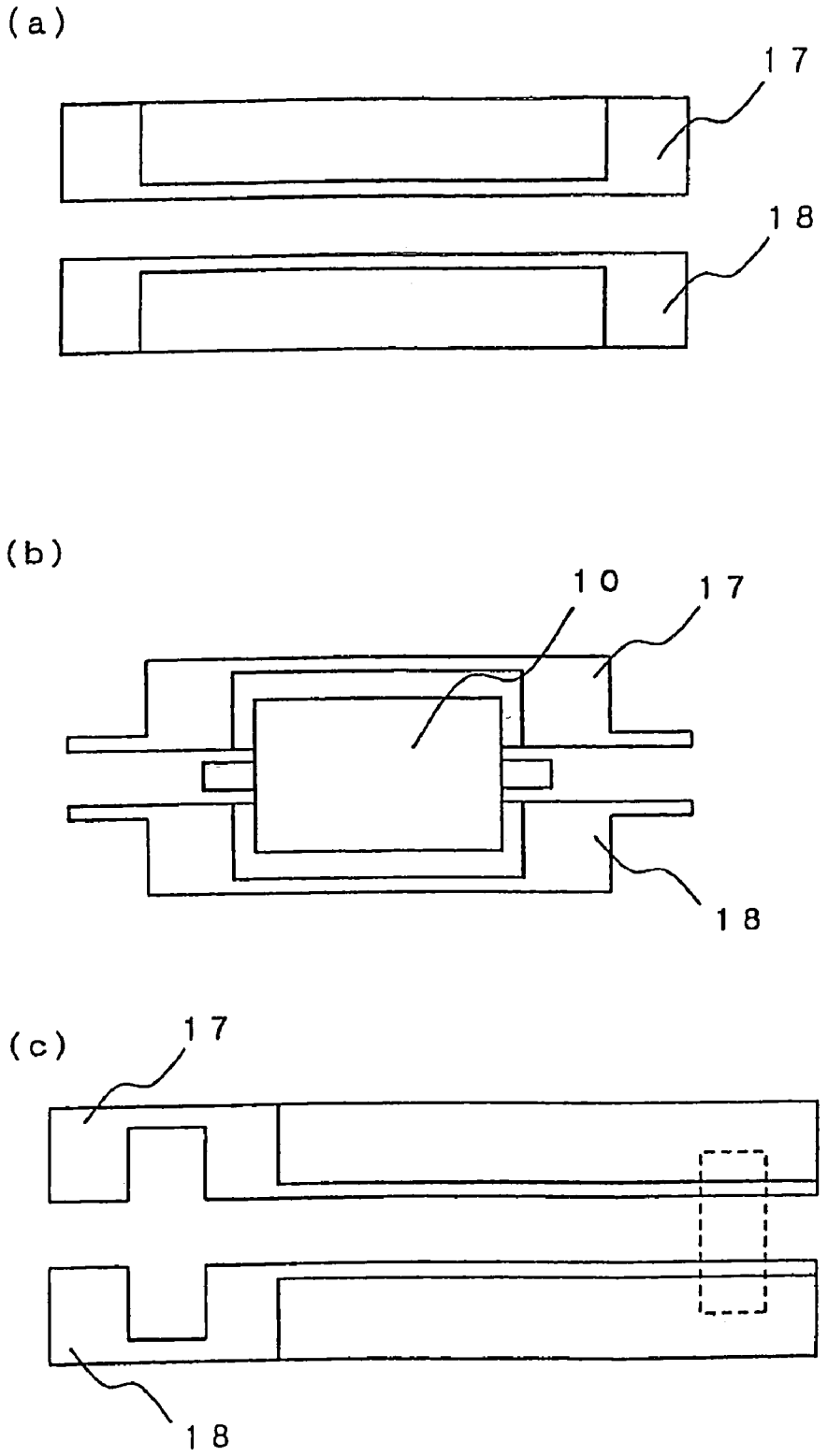
FIG. 14(*a*) is a side elevation viewed from a direction A of FIG. 13, FIG. 14(*b*) is a side elevation viewed from a direction B of FIG. 13, and FIG. 14(*c*) is a side elevation viewed from a direction C of FIG. 13.

FIG. 13 is a cross sectional view showing an arrangement of a high frequency module according to Embodiment 7 of the present invention, FIG. 14(*a*) is a side elevation viewed from a direction A of FIG. 13, FIG. 14(*b*) is a side elevation viewed from a direction B of FIG. 13, and FIG. 14(*c*) is a side elevation viewed from a direction C of FIG. 13. In Embodiment 5 described above, the metal plate 19 for support is provided on the low noise amplifier 10. Usually, however, between an outer wall wider face of the low noise amplifier 10 and the ground face of the metal plate 19, a gap may be made which is inevitable in assembly. In this case, since some artificial waveguide modes are transmitted in this gap, an unwanted coupling is excited between the waveguide/MIC converters 8 and 9, which results in degradation of characteristics.

In this embodiment, as shown in FIG. 13, a gap is deliberately provided between the outer wall wider face of the low noise amplifier 10 and a ground face of a metal plate 20, and a one-side capacitive iris-coupled rectangular waveguide band-pass filter 21 is provided, the waveguide wider faces of which include the outer wall wider faces of the above-described metal plate and the above-described low noise amplifier.

Note that, an operation is not described because the operation is similar to that of Embodiment 2.

In this way, since the high frequency module in this embodiment is arranged as described above, the high frequency module provides an effect, in addition to that of Embodiment 5, in that the above-described unwanted coupling is suppressed and the degradation of characteristics can be avoided.

Embodiment 8

Figure 15:
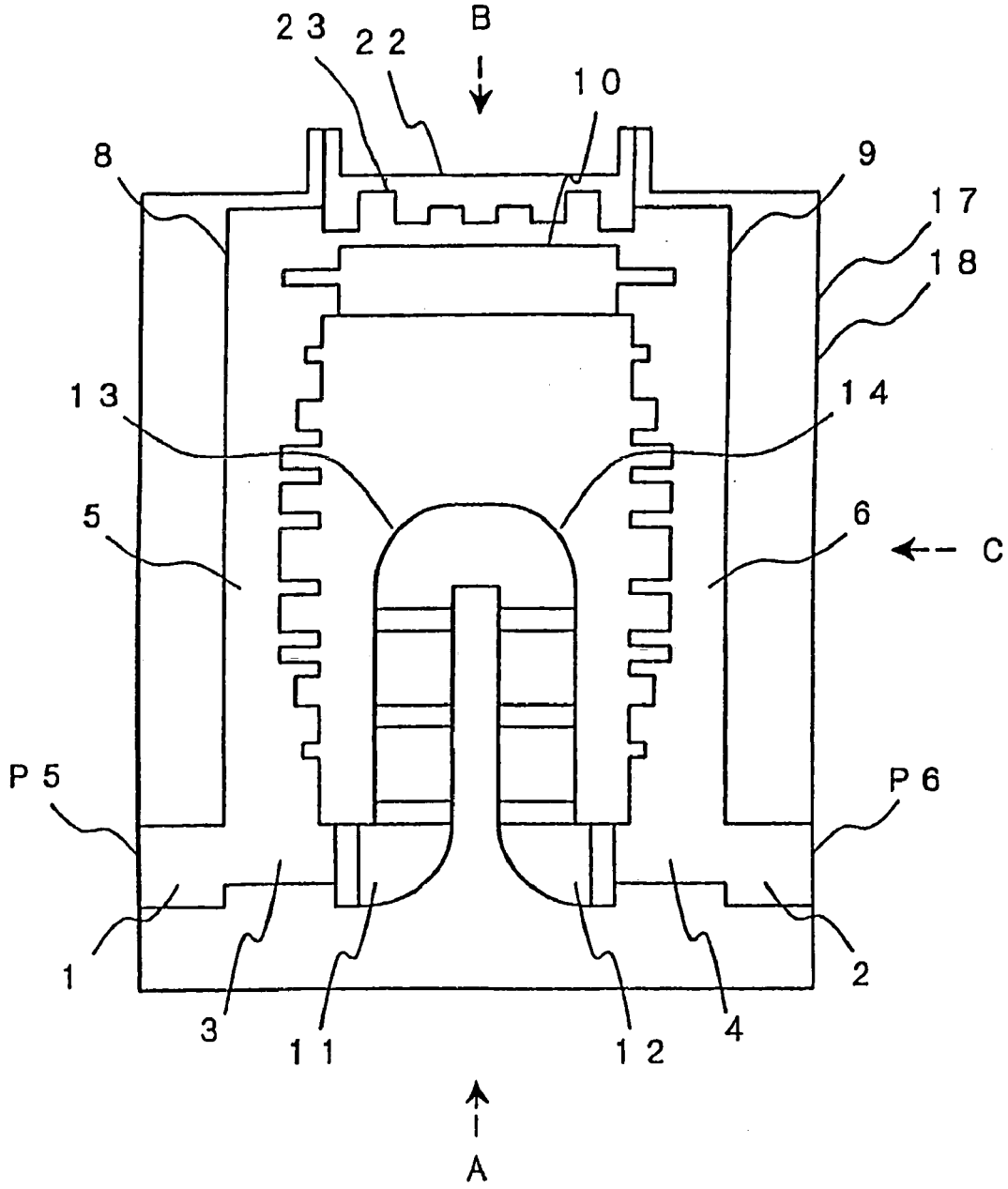
FIG. 15 is a top view showing an arrangement of a high frequency module according to Embodiment 8 of the present invention.
Figure 16:
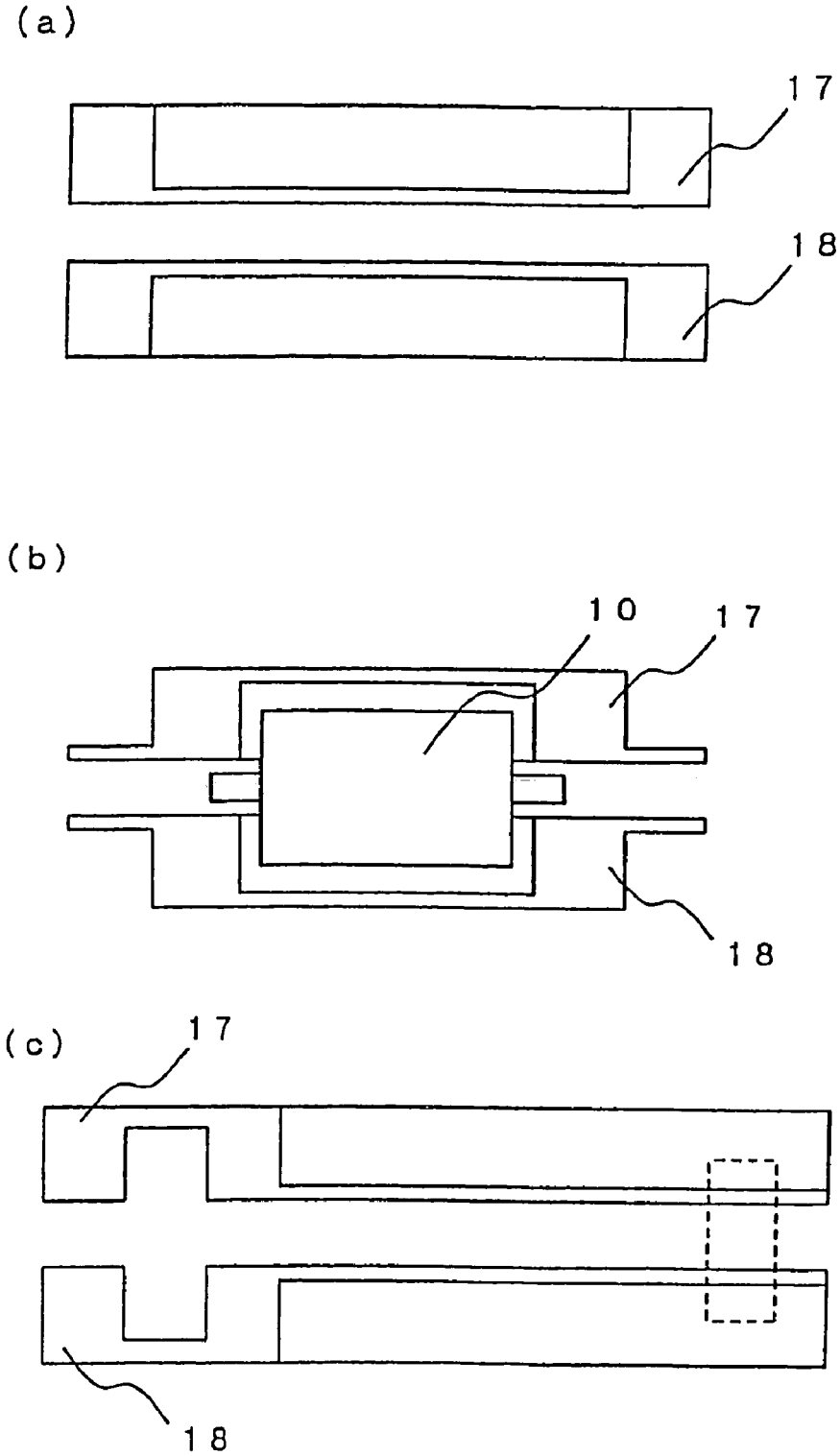
FIG. 16(*a*) a side elevation viewed from a direction A of FIG. 15, FIG. 16(*b*) is a side elevation viewed from a direction B of FIG. 15, and FIG. 16(*c*) is a side elevation viewed from a direction C of FIG. 15.

FIG. 15 is a top view showing an arrangement of a high frequency module according to Embodiment 8 of the present invention, FIG. 16(*a*) is a side elevation viewed from a direction A of FIG. 15, FIG. 16(*b*) is a side elevation viewed from a direction B of FIG. 15, and FIG. 16(*c*) is a side elevation viewed from a direction C of FIG. 15. In Embodiment 7 described above, the gap is provided between the outer wall wider face of the low noise amplifier 10 and the ground face of the metal plate 20, where a waveguide band-pass filter 23 is provided. As shown in FIG. 8, however, a gap is provided between the outer wall wider face of the low noise amplifier 10 and a ground face of a metal plate 22, where a one-side corrugated rectangular waveguide low-pass filter 23 is placed.

Note that, an operation is not described because the operation is similar to that of Embodiment 2.

In this way, since the high frequency module in this embodiment is arranged as described above, an effect similar to that of Embodiment 7 is achieved.

Embodiment 9.

Figure 17:
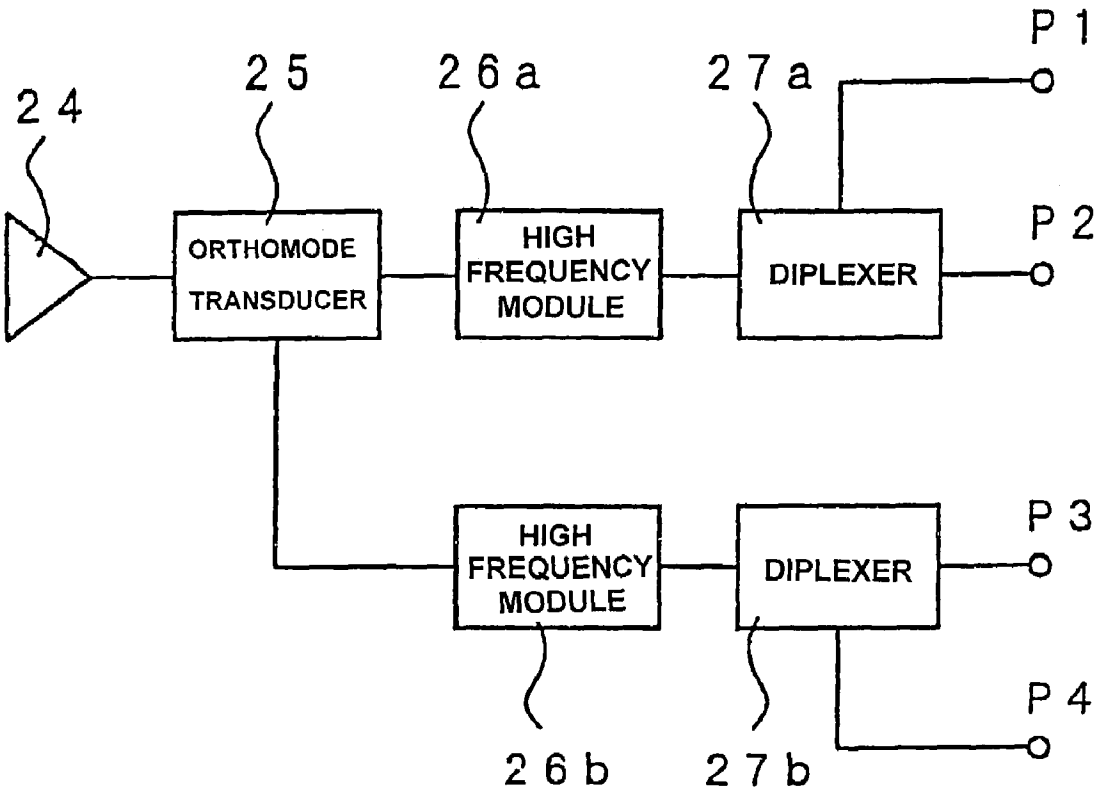
FIG. 17 is a block diagram showing an arrangement of an antenna apparatus according to Embodiment 9 of the present invention.

FIG. 17 is a block diagram showing an arrangement of an antenna apparatus according to Embodiment 9 of the present invention. In the figure, reference numeral 24 denotes a primary radiator for transmitting both vertical and horizontal linearly polarized waves in a first frequency band to a main- or sub-reflector and for receiving both vertical and horizontal linearly polarized waves in a second frequency band from the main- or sub-reflector; 25, an orthomode transducer; 26*a*, a high frequency module in the above-described Embodiment 5 connected to the orthomode transducer 24; 26*b*, a high frequency module in the above-described Embodiment 5 connected to the orthomode transducer 24; 27*a*, a diplexer described below; P1, an input terminal for radio waves in the first frequency band transmitted from the primary radiator 24 in a vertically polarized wave; P2, an output terminal for radio waves in the second frequency band received by the primary radiator 24 in a vertically polarized wave; P3, an input terminal for radio waves in the first frequency band transmitted from the primary radiator 24 in a horizontally polarized wave; and P4, an output terminal for radio waves in the second frequency band received by the primary radiator 24 in a horizontally polarized wave.

Next, an operation will be described.

First, a linearly polarized radio wave in the first frequency band inputted from the input terminal P1 passes through the diplexer 27*a* and the high frequency module 26*a*, is inputted to the orthomode transducer 25, and is outputted as a vertically polarized wave. The vertically polarized wave then passes through the primary radiator 24 and is radiated from the reflector into the air.

Furthermore, a vertically polarized radio wave in the second frequency band received by the reflector passes through the primary radiator 24 and is inputted to the orthomode transducer 25. The radio wave is then amplified by the high frequency module 26*a*, is carried to the diplexer 27*a*, and is extracted from the output terminal P2 as a linearly polarized wave.

Next, a linearly polarized radio wave in the first frequency band inputted from the input terminal P3 passes through the diplexer 27*b* and the high frequency module 26*b*, is inputted to the orthomode transducer 25, and is outputted as a horizontally polarized wave. The horizontally polarized wave then passes through the primary radiator 24 and is radiated from the reflector into the air.

Furthermore, a horizontally polarized radio wave in the second frequency band received by the reflector passes through the primary radiator 24 and is inputted to the orthomode transducer 25. The radio wave is then amplified by the high frequency module 26*b*, is carried to the diplexer 27*b*, and is extracted from the output terminal P4 as a linearly polarized wave.

Here, the radio waves in the first frequency band inputted from the input terminal P1 and the input terminal P3 hardly leak into the output terminal P2 and the output terminal P4 owing to isolation characteristics of the diplexers 27*a* and 27*b*. Furthermore, since the radio waves are converted by the orthomode transducer 25 into polarized waves which are mutually orthogonal, little interference occurs between the two radio waves. Accordingly, two transmission waves using the same frequency band and having both vertical and horizontal polarized waves will be efficiently radiated from the primary radiator 24.

Furthermore, two radio waves using the same frequency band and having both vertical and horizontal polarized waves, received by the primary radiator 24, are isolated by the orthomode transducer 25 without any interference therebetween. Furthermore, each isolated radio wave hardly leaks into the input terminal P1 and the input terminal P3 owing to the isolation characteristics of the diplexers 27*a* and 27*b*. Accordingly, two transmission waves using the same frequency band and having differently rotating circular polarized waves will be efficiently outputted from the output terminal 2 and the output terminal 4.

In this way, according to this Embodiment 9, a radio wave received at the reflector is amplified once in the high frequency modules 26*a* and 26*b* while the radio wave is carried to a receiver connected to the output terminal P2 and the output terminal P4. This eliminates the need to locate the orthomode transducer 25, the diplexers 27*a* and 27*b*, and the receiver in proximity, which results in an effect in that flexibility of the configuration of those circuits is enhanced. Furthermore, when machine-driven manipulation of antenna beams is performed, it is not necessary to locate the diplexers 27*a* and 27*b* and the receiver at places where they rotate with the reflector. This provides an effect of being capable of obtaining an antenna apparatus whose rotating mechanism and rotation supporting mechanism can be made compact and lightweight and which has high performance.

Embodiment 10.

Figure 18:
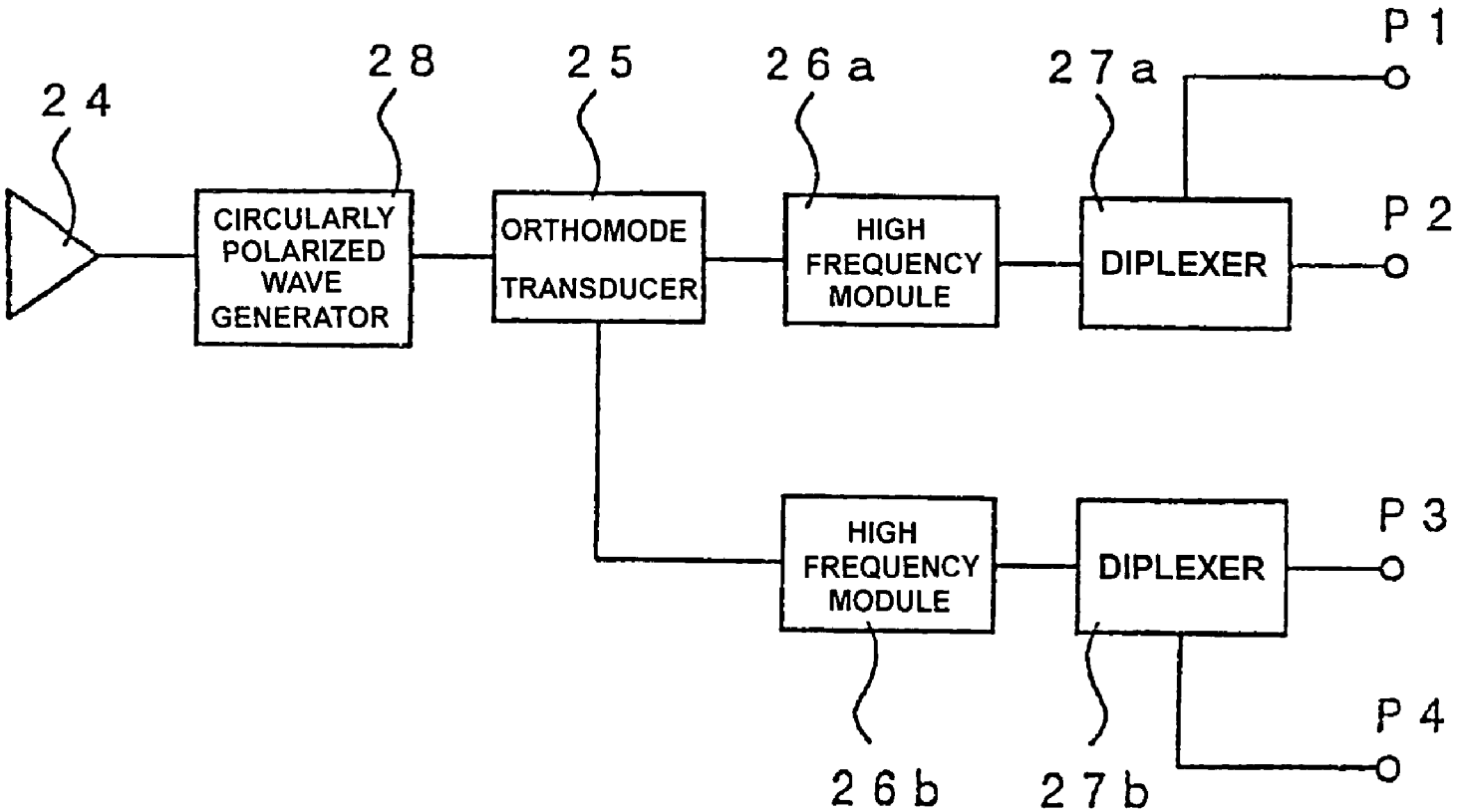
FIG. 18 is a block diagram showing an arrangement of an antenna apparatus according to Embodiment 10 of the present invention.
Figure 19:
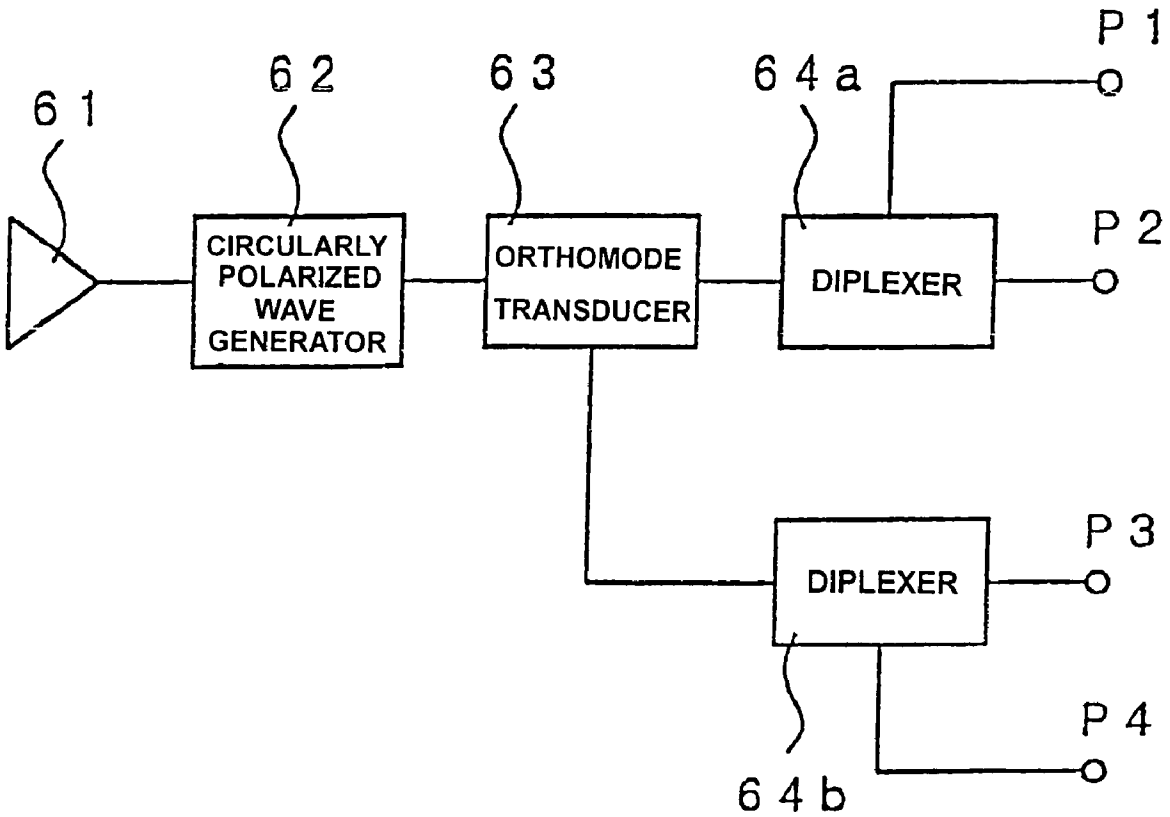
FIG. 19 PRIOR ART
FIG. 19 is a block diagram showing an arrangement of a conventional antenna apparatus.

FIG. 18 is a block diagram showing an arrangement of an antenna apparatus according to Embodiment 10 of the present invention. In the figure, reference numeral 24 denotes a primary radiator for transmitting both left- and right-handed circularly polarized waves in a first frequency band to a main- or sub-reflector and for receiving both left- and right-handed circularly polarized waves in a second frequency band from the main- or sub-reflector; 25, an orthomode transducer connected to a polarizer 28 to be described below; 26*a*, a high frequency module in the above-described Embodiment 5 connected to the orthomode transducer 25; 26*b*, a high frequency module in the above-described Embodiment 5 connected to the orthomode transducer 25; 27*a*, a diplexer connected to the high frequency module 26*a*; 27*b*, a diplexer connected to the high frequency module 26*b*; 28, a polarizer provided between the primary radiator 24 and the orthomode transducer 25; P1, an input terminal, connected to the diplexer 27*a*, for radio waves in the first frequency band transmitted from the primary radiator 24 in a left-handed circular polarized wave; P2, an output terminal, connected to the diplexer 27*a*, for radio waves in the second frequency band received from the primary radiator 24 in a left-handed circular polarized wave; P3, an input terminal, connected to the diplexer 27*b*, for radio waves in the first frequency band transmitted from the primary radiator 24 in a right-handed circular polarized wave; and P4, an input terminal, connected to the diplexer 27*b*, for radio waves in the second frequency band received from the primary radiator 24 in a right-handed circular polarized wave.

Next, an operation will be described.

First, a linearly polarized radio wave in the first frequency band inputted from the input terminal P1 passes through the diplexer 27*a* and the high frequency module 26*a*, is inputted to the orthomode transducer 25, and is outputted as a vertically polarized wave. The vertically polarized wave is then converted by the polarizer 28 to a left-handed circularly polarized wave, passes through the primary radiator 24, and is radiated from the reflector into the air.

Furthermore, a left-handed circularly polarized radio wave in the second frequency band received by the reflector passes through the primary radiator 24, is converted by the polarizer 28 to a vertically polarized wave, and is inputted to the orthomode transducer 25. The radio wave is then amplified by the high frequency module 26*a*, is carried to the diplexer 27*a*, and is extracted from the output terminal P2 as a linearly polarized wave.

Next, a linearly polarized radio wave in the first frequency band inputted from the input terminal P3 passes through the diplexer 27*b* and the high frequency module 26*b*, is inputted to the orthomode transducer 25, and is outputted as a horizontally polarized wave. The horizontally polarized wave is then converted by the polarizer 28 to a right-handed circularly polarized wave, passes through the primary radiator 24, and is radiated from the reflector into the air.

Furthermore, a right-handed circularly polarized radio wave in the second frequency band received by the reflector passes through the primary radiator 24, is converted by the polarizer 28 from the right-handed circularly polarized wave to a horizontally polarized wave, and is inputted to the orthomode transducer 25. The horizontally polarized wave is then amplified by the high frequency module 26*b*, is carried to the diplexer 27*b*, and is extracted from the output terminal P4 as a linearly polarized wave.

Here, the radio waves in the first frequency band inputted from the input terminal P1 and the input terminal P3 hardly leak into the output terminal P2 and the output terminal P4 owing to isolation characteristics of the diplexers 27*a* and 27*b*. Furthermore, since the radio waves are converted by the orthomode transducer 25 into polarized waves which are mutually orthogonal, little interference occurs between the two radio waves. Accordingly, two transmission waves using the same frequency band and having both left- and right-handed circular polarized waves will be efficiently radiated from the primary radiator 24.

Further, two radio waves using the same frequency band and having both left- and right-handed circular polarized waves, received by the primary radiator 24, are converted into two linearly polarized waves which are mutually orthogonal without any interference therebetween and isolated by the polarizer 28 and the orthomode transducer 25. Furthermore, each isolated radio wave hardly leaks into the output terminal P1 and the output terminal P3 owing to the isolation characteristics of the diplexers 27*a* and 27*b*. Accordingly, two transmission waves using the same frequency band and having differently rotating circular polarized waves will be efficiently outputted from the output terminal 2 and the output terminal 4.

In this way, according to this Embodiment 10, a radio wave received at the reflector is amplified once in the high frequency modules 26*a* and 26*b* while the radio wave is carried to a receiver connected to the output terminal P2 and the output terminal P4. This eliminates the need to locate the orthomode transducer 25, the diplexers 27*a* and 27*b*, and the receiver in proximity, which results in an effect in that flexibility of the configuration of those circuits is enhanced. Furthermore, when machine-driven manipulation of antenna beams is performed, it is not necessary to locate the diplexers 27*a* and 27*b* and the receiver at places where they rotate with the reflector. This provides an effect of being capable of obtaining an antenna apparatus whose rotating mechanism and rotation supporting mechanism can be made compact and lightweight and which has high performance.

Hereinafter, effects of the present invention are described.

A high frequency module according to the present invention includes: a first main waveguide; a first T-branch circuit connected to the first main waveguide; a first low-pass filter connected to the first T-branch circuit for transmitting a first frequency band and reflecting a second frequency band; a band-pass filter connected to the first T-branch circuit for transmitting the second frequency band and reflecting the first frequency band; a first converter connected to the first low-pass filter for converting transmission lines between a waveguide and a microwave integrated circuit; an amplifier connected to the first converter and structured by the microwave integrated circuit; a second converter connected to the amplifier for converting transmission lines between a waveguide and the microwave integrated circuit; a second low-pass filter connected to the second converter for transmitting the first frequency band and reflecting the second frequency band; a second T-branch circuit connected to the second low-pass filter and the band-pass filter; and a second main waveguide connected to the second T-branch circuit. Accordingly, the effect can be obtained in which a radio wave in the first frequency band can be amplified and passed effectively without being oscillated, and a radio wave in the second frequency band input opposing to the radio wave in the first frequency band can be passed with little loss.

A high frequency module according to the present invention includes: a first main waveguide; a first T-branch circuit connected to the first main waveguide; a first low-pass filter connected to the first T-branch circuit for transmitting a first frequency band and reflecting a second frequency band; a first band-pass filter connected to the first T-branch circuit and having a partially bent longitudinal axis for transmitting the second frequency band and reflecting the first frequency band; a first converter connected to the first low-pass filter for converting transmission lines between a waveguide and a microwave integrated circuit; an amplifier connected to the first converter and structured by the microwave integrated circuit; a second converter connected to the amplifier for converting transmission lines between a waveguide and the microwave integrated circuit; a second low-pass filter connected to the second converter for transmitting the first frequency band and reflecting the second frequency band; a first bend connected to the first band-pass filter; a second bend connected to the first bend; a second band-pass filter connected to the second bend and having a partially bent longitudinal axis for transmitting the second frequency band and reflecting the first frequency band; a second T-branch circuit connected to the second low-pass filter and the second band-pass filter; and a second main waveguide connected to the second T-branch circuit. Accordingly, the effect can be obtained in which a radio wave in the first frequency band can be amplified and passed effectively without being oscillated, and a radio wave in the second frequency band input opposing to the radio wave in the first frequency band can be passed with little loss.

A high frequency module according to the present invention includes: a first main waveguide; a first T-branch circuit connected to the first main waveguide; a first band-pass filter connected to the first T-branch circuit for transmitting a first frequency band and reflecting a second frequency band; a second band-pass filter connected to the first T-branch circuit for transmitting the second frequency band and reflecting the first frequency band; a first converter connected to the first band-pass filter for converting transmission lines between a waveguide and a microwave integrated circuit; an amplifier connected to the first converter and structured by the microwave integrated circuit for converting transmission lines between a waveguide and the microwave integrated circuit; a second converter connected to the amplifier; a third band-pass filter connected to the second converter for transmitting the first frequency band and reflecting the second frequency band; a second T-branch circuit connected to the third band-pass filter and the second band-pass filter; and a second main waveguide connected to the second T-branch circuit. Accordingly, the effect can be obtained in which a radio wave in the first frequency band can be amplified and passed effectively without being oscillated, and a radio wave in the second frequency band input opposing to the radio wave in the first frequency band can be passed with little loss.

A high frequency module according to the present invention includes: a first main waveguide; a first T-branch circuit connected to the first main waveguide; a first band-pass filter connected to the first T-branch circuit for transmitting a first frequency band and reflecting a second frequency band; a second band-pass filter connected to the first T-branch circuit and having a partially bent longitudinal axis for transmitting the second frequency band and reflecting the first frequency band; a first converter connected to the first band-pass filter for converting transmission lines between a waveguide and a microwave integrated circuit; an amplifier connected to the first converter and structured by the microwave integrated circuit; a second converter connected to the amplifier for converting transmission lines between a waveguide and the microwave integrated circuit; a third band-pass filter connected to the second converter for transmitting the first frequency band and reflecting the second frequency band; a first bend connected to the second band-pass filter; a second bend connected to the first bend; a fourth band-pass filter connected to the second bend and having a partially bent longitudinal axis for transmitting the second frequency band and reflecting the first frequency band; a second T-branch circuit connected to the third band-pass filter and the fourth band-pass filter; and a second main waveguide connected to the second T-branch circuit. Accordingly, the effect can be obtained in which a radio wave in the first frequency band can be amplified and passed effectively without being oscillated, and a radio wave in the second frequency band input opposing to the radio wave in the first frequency band can be passed with little loss.

Further, the high frequency module includes a one-side corrugated rectangular waveguide low-pass filter as the waveguide band-pass filter. Accordingly, the effect can be obtained in which a radio wave in the first frequency band can be amplified and passed effectively without being oscillated, and a radio wave in the second frequency band input opposing to the radio wave in the first frequency band can be passed with little loss.

Further, the high frequency module includes an inductive iris-coupled rectangular waveguide band-pass filter as the waveguide band-pass filter. Accordingly, the effect can be obtained in which a radio wave in the first frequency band can be amplified and passed effectively without being oscillated, and a radio wave in the second frequency band input opposing to the radio wave in the first frequency band can be passed with little loss.

Further, the high frequency module is characterized in that the T-branch circuit is provided with a matching step at its branch point. Accordingly, radio waves in the first and second frequency bands can be input and output effectively.

Further, the high frequency module is structured by combining two metal blocks to which the main waveguides, the T-branch circuits, the low-pass filters or the waveguide band-pass filters, the band-pass filter or the band-pass filters each having a partially bent longitudinal axis and the bends, and waveguide portions of the converters are bored. Accordingly, a connect supporting mechanism for each component can be reduced.

Further, the high frequency module is characterized in that the amplifier has one metal plate thereon, and in a gap between the metal plate and an outer wall wider face of the amplifier, a one-side capacitive iris-coupled rectangular waveguide low-pass filter is provided, the waveguide inner walls of which include the metal plate and the outer wall wider face of the amplifier. Accordingly, unwanted connection can be restrained.

Further, the high frequency module is characterized in that the amplifier has one metal plate thereon, and in a gap between the metal plate and an outer wall wider face of the amplifier, a one-side corrugated rectangular waveguide low-pass filter is provided, the waveguide inner walls of which include the metal plate and the outerwall wider face of the amplifier. Accordingly, unwanted connection can be restrained.

An antenna apparatus according to the present invention includes: a primary radiator; an orthomode transducer connected to the primary radiator; any one of the above-mentioned first high frequency module, connected to the orthomode transducer; a first diplexer connected to the first high frequency module; any one of the above-mentioned second high frequency module, connected to the orthomode transducer; and a second diplexer connected to the second high frequency module. Therefore, the present invention can make the apparatus compact and lightweight.

An antenna apparatus according to the present invention includes: a primary radiator; a polarizer connected to the primary radiator; an orthomode transducer connected to the polarizer; any one of the above-mentioned first high frequency module, connected to the orthomode transducer; a first diplexer connected to the first high frequency module; any one of the above-mentioned second high frequency module, connected to the orthomode transducer; and a second diplexer connected to the second high frequency module. Therefore, the present invention can make the apparatus compact and light weight.

INDUSTRIAL APPLICABILITY

As described above, the high frequency module according to the present invention is useful as a waveguide diplexer and a low noise amplifier provided to an antenna. The antenna apparatus according to the present invention is useful as a signal transceiver in radio communication for VHF, UHF, microwave, and millimeter wave bands.

What is claimed is:

1. A high frequency module, characterized by comprising:

a first main waveguide;

a first T-branch circuit connected to the first main waveguide;

a first low-pass filter connected to the first T-branch circuit for transmitting a first frequency band and reflecting a second frequency band;

a band-pass filter connected to the first T-branch circuit for transmitting the second frequency band and reflecting the first frequency band;

a first converter connected to the first low-pass filter for converting transmission lines between a waveguide and a microwave integrated circuit;

an amplifier connected to the first converter and structured by the microwave integrated circuit;

a second converter connected to the amplifier for converting transmission lines between a waveguide and the microwave integrated circuit;

a second low-pass filter connected to the second converter for transmitting the first frequency band and reflecting the second frequency band;

a second T-branch circuit connected to the second low-pass filter and the band-pass filter;

and a second main waveguide connected to the second T-branch circuit.

2. A high frequency module according to claim 1, characterized in that the band-pass filter comprises a first band-pass filter connected to the first T-branch circuit and having a partially bent longitudinal axis for transmitting the second frequency band and reflecting the first frequency band, characterized by further comprising:

a first bend connected to the first band-pass filter;

a second bend connected to the first bend;

a second band-pass filter connected to the second bend and having a partially bent longitudinal axis for transmitting the second frequency band and reflecting the first frequency band, characterized in that the second T-branch circuit connected to the second low-pass filter and the second band-pass filter.

3. A high frequency module according to claim 1, characterized by further comprising a one-side corrugated rectangular waveguide low-pass filter as the low-pass filter.

4. A high frequency module according to claim 1, characterized by further comprising an inductive iris-coupled rectangular waveguide band-pass filter as the band-pass filter.

5. A high frequency module according to claim 1, characterized in that the T-branch circuit is provided with a matching step at its branch point.

6. A high frequency module according to claim 1, characterized by being structured by combining two metal blocks to which the main waveguides, the T-branch circuits, the low-pass filters or the band-pass filters, the band-pass filter or the band-pass filters each having a partially bent longitudinal axis and the bends, and waveguide portions of the converters are bored.

7. A high frequency module according to claim 6, characterized in that the amplifier has one metal plate thereon, and in a gap between the metal plate and an outer wall wider face of the amplifier, a one-side capacitive iris-coupled rectangular waveguide low-pass filter is provided, the waveguide inner walls of which comprise the metal plate and the outer wall wider face of the amplifier.

8. A high frequency module according to claim 6, characterized in that the amplifier has one metal plate thereon, and in a gap between the metal plate and an outer wall wider face of the amplifier, a one-side corrugated rectangular waveguide low-pass filter is provided, the waveguide inner walls of which comprise the outer wall wider face of the metal plate and the amplifier.

9. A high frequency module, characterized by comprising:

a first main waveguide;

a first T-branch circuit connected to the first main waveguide;

a first band-pass filter connected to the first T-branch circuit for transmitting a first frequency band and reflecting a second frequency band;

a second band-pass filter connected to the first T-branch circuit for transmitting the second frequency band and reflecting the first frequency band;

a first converter connected to the first band-pass filter for converting transmission lines between a waveguide and a microwave integrated circuit;

an amplifier connected to the first converter and structured by the microwave integrated circuit for converting transmission lines between a waveguide and the microwave integrated circuit;

a second converter connected to the amplifier;

a third band-pass filter connected to the second converter for transmitting the first frequency band and reflecting the second frequency band;

a second T-branch circuit connected to the third band-pass filter and the second band-pass filter;

and a second main waveguide connected to the second T-branch circuit.

10. A high frequency module, characterized by comprising:

a first main waveguide;

a first T-branch circuit connected to the first main waveguide;

a first band-pass filter connected to the first T-branch circuit for transmitting a first frequency band and reflecting a second frequency band;

a second band-pass filter connected to the first T-branch circuit and having a partially bent longitudinal axis for transmitting the second frequency band and reflecting the first frequency band;

a first converter connected to the first band-pass filter for converting transmission lines between a waveguide and a microwave integrated circuit;

an amplifier connected to the first converter and structured by the microwave integrated circuit; a second converter connected to the amplifier for converting transmission lines between a waveguide and the microwave integrated circuit;

a third band-pass filter connected to the second converter for transmitting the first frequency band and reflecting the second frequency band;

a first bend connected to the second band-pass filter;

a second bend connected to the first bend;

a fourth band-pass filter connected to the second bend and having a partially bent longitudinal axis for transmitting the second frequency band and reflecting the first frequency band;

a second T-branch circuit connected to the third band-pass filter and the fourth band-pass filter;

and a second main waveguide connected to the second T-branch circuit.

* * * * *